US010170227B2

(12) United States Patent
Tanaka et al.

(10) Patent No.: US 10,170,227 B2
(45) Date of Patent: Jan. 1, 2019

(54) ELECTOMAGNETIC DRIVER

(71) Applicants: DENSO CORPORATION, Kariya, Aichi-pref. (JP); ANDEN CO., LTD., Anjo, Aichi-pref. (JP)

(72) Inventors: Ken Tanaka, Nishio (JP); Shota Iguchi, Kariya (JP); Hiroaki Murakami, Anjo (JP)

(73) Assignees: DENSO CORPORATION, Kariya (JP); ANDEN CO., LTD., Anjo (JP)

( * ) Notice: Subject to any disclaimer, the term of this patent is extended or adjusted under 35 U.S.C. 154(b) by 0 days.

(21) Appl. No.: 15/686,504

(22) Filed: Aug. 25, 2017

(65) Prior Publication Data

US 2018/0061544 A1 Mar. 1, 2018

(30) Foreign Application Priority Data

Aug. 31, 2006 (JP) ..... 2016-169786

(51) Int. Cl.

| | |
|---|---|
| ***H01F 7/16*** | (2006.01) |
| ***H01F 41/02*** | (2006.01) |
| ***H01F 3/00*** | (2006.01) |
| *H01F 7/08* | (2006.01) |

(52) U.S. Cl.

CPC ..... *H01F 7/1653* (2013.01); *H01F 3/00* (2013.01); *H01F 41/02* (2013.01); *H01F 7/08* (2013.01); *H01F 2007/086* (2013.01)

(58) Field of Classification Search

CPC ..... H01F 2007/086; H01F 3/00; H01F 41/02; H01F 7/1653

See application file for complete search history.

(56) References Cited

U.S. PATENT DOCUMENTS

| | | | | |
|---|---|---|---|---|
| 1,713,073 | A * | 5/1929 | Carter | F04B 43/04 310/34 |
| 2010/0207713 | A1* | 8/2010 | Sugisawa | H01H 50/54 335/192 |
| 2013/0207750 | A1* | 8/2013 | Daitoku | H01H 50/00 335/126 |
| 2014/0042347 | A1* | 2/2014 | Williams | F16K 31/0606 251/129.02 |
| 2014/0225691 | A1 | 8/2014 | Tanaka et al. | |

FOREIGN PATENT DOCUMENTS

| | | |
|---|---|---|
| JP | 2011-185306 A | 9/2011 |
| JP | 2015-170562 A | 9/2015 |

* cited by examiner

*Primary Examiner* — Mohamad Musleh
(74) *Attorney, Agent, or Firm* — Oliff PLC

(57) ABSTRACT

In a main magnetic circuit, first pulling force generated based on a first component of the magnetic flux flowing through the main magnetic path pulls a movable core in a reciprocation direction of the movable core. The first pulling force increases with a reduction of a dimension of the gap. In an auxiliary magnetic circuit, second pulling force generated based on the second component of the magnetic flux flowing through the auxiliary magnetic path pulls the movable core in the reciprocation direction of the movable core. In the auxiliary magnetic circuit, the second pulling force with the dimension of the gap being within a first range is changed to be higher than the second pulling force with the dimension of the gap being within a second range, the second range being smaller than the first range.

7 Claims, 9 Drawing Sheets

ELECTOMAGNETIC DRIVER

CROSS REFERENCE TO RELATED APPLICATIONS

This application is based on and claims the benefit of priority from Japanese Patent Application 2016-169786 filed on Aug. 31, 2016, the disclosure of which is incorporated in its entirety herein by reference.

TECHNICAL FIELD

The present disclosure relates to electromagnetic drivers for driving a movable core using both electromagnetic attractive force and spring force.

BACKGROUND

Typical electromagnetic relays include such an electromagnetic driver, an example of which is disclosed in Japanese Patent Application Publication No. 2015-170562, which is referred to as a published patent document. A conventional electromagnetic relay disclosed in the published patent document includes a coil, a movable core, a stationary core, a return spring, a stationary contact member, a movable contact member, and a contact pressure spring. The coil is configured to generate a magnetic field when energized. The movable core is disposed to be away from the stationary core, and is configured to be reciprocable with respect to the stationary core. The dimension, i.e. the size or length, of the gap, i.e. interval, between the movable core and the stationary core in the reciprocation direction will be referred to as a gap dimension. When the movable core is disposed at a predetermined original position, the gap dimension has a maximum value. In other words, the movable core is configured to start to move toward the stationary core from the original position at which the gap dimension has the maximum value.

The coil is configured to pull the movable core to the stationary core when energized. The return spring is configured to urge the movable core in a direction away from the stationary core. That is, the pulling force of the coil and the urging force of the return spring enable the movable core to be reciprocated with respect to the stationary core.

The stationary contact member is connected to an external electrical circuit, and the movable contact member is configured to follow the movement of the movable core to be in contact with or in separation from the stationary contact member. The contact pressure spring is configured to urge the movable contact member toward the stationary contact member.

SUMMARY

As described above, the gap dimension changes depending on reciprocation of the movable core with respect to the stationary core. That is, the electromagnetic relay disclosed in the published patent document is configured such that, the smaller the gap dimension is due to the pulling of the coil to the stationary core, the greater the pulling force of the coil is in the form of a quadratic curve (see CONVENTIONAL PULLING FORCE in FIG. 4 described later).

This change of the pulling force in the form of a quadratic curve results in

1. The pulling force having a large value when the gap dimension is within a small range 2. The pulling force having a small value when the gap dimension is within a large range, i.e. the gap dimension is close to the maximum value Upsizing of the coil would enable the pulling force to increase when the gap dimension is close to the maximum value. This would however result in the conventional electromagnetic relay being upsized.

In addition, the conventional electromagnetic relay disclosed in the published patent document is configured such that the resultant force, which is illustrated as SPRING FORCE in FIG. 4, of the urging force of the return spring and the urging force of the contact pressure spring linearly increases as the gap dimension decreases. In particular, the resultant force of the urging force of the return spring and the urging force of the contact pressure spring immediately rises when the movable contact member abuts on the stationary contact member (see FIG. 4). Upsizing of the coil would enable the pulling force to be higher than a value of the resultant force when the movable contact member abuts on the stationary contact member. This would however result in the electromagnetic relay being upsized.

In view of the circumstances set forth above, one aspect of the present disclosure seeks to provide electromagnetic drivers, each of which is designed to solve the problem set forth above.

Specifically, an alternative aspect of the present disclosure aims to provide such electromagnetic drivers, each of which is capable of achieving larger pulling force that pulls a movable core to a stationary core when the dimension of a gap between the movable core and the stationary core has a maximum value.

According to an exemplary aspect of the present disclosure, there is provided an electromagnetic driver. The electromagnetic driver includes a stationary core, and a movable core located to face the stationary core with a variable gap relative to the stationary core. The movable core is configured to be reciprocable relative to the stationary core. The electromagnetic driver includes a spring configured to urge the movable core to be away from the stationary core, and a coil configured to generate magnetic flux when energized. The stationary core includes a main magnetic circuit through which a first component of the magnetic flux flows. The main magnetic circuit is configured such that first pulling force, i.e. first attractive force, generated based on the first component of the magnetic flux flowing through the main magnetic path pulls the movable core in a reciprocation direction of the movable core, and the first pulling force increases with a reduction of a dimension of the gap. The stationary core includes an auxiliary magnetic circuit through which a second component of the magnetic flux flows. The auxiliary magnetic circuit is configured such that second pulling force, i.e. second attractive force, generated based on the second component of the magnetic flux flowing through the auxiliary magnetic path pulls the movable core in the reciprocation direction of the movable core, and the second pulling force with the dimension of the gap being within a first range is changed to be higher than the second pulling force with the dimension of the gap being within a second range, the second range being smaller than the first range.

This configuration provided with the auxiliary magnetic circuit enables the pulling force in the reciprocation direction of the movable core while the dimension of the gap is within the first range, i.e. large range, to increase greater.

The above and/or other features, and/or advantages of various aspects of the present disclosure will be further appreciated in view of the following description in conjunction with the accompanying drawings. Various aspects of the present disclosure can include and/or exclude different features, and/or advantages where applicable. In addition, various aspects of the present disclosure can combine one or more features of other embodiments where applicable. The descriptions of features, and/or advantages of particular embodiments should not be construed as limiting other embodiments or the claims.

BRIEF DESCRIPTION OF THE DRAWINGS

Other aspects of the present disclosure will become apparent from the following description of an embodiment with reference to the accompanying drawings in which.

DETAILED DESCRIPTION OF EMBODIMENT

Figure 1:
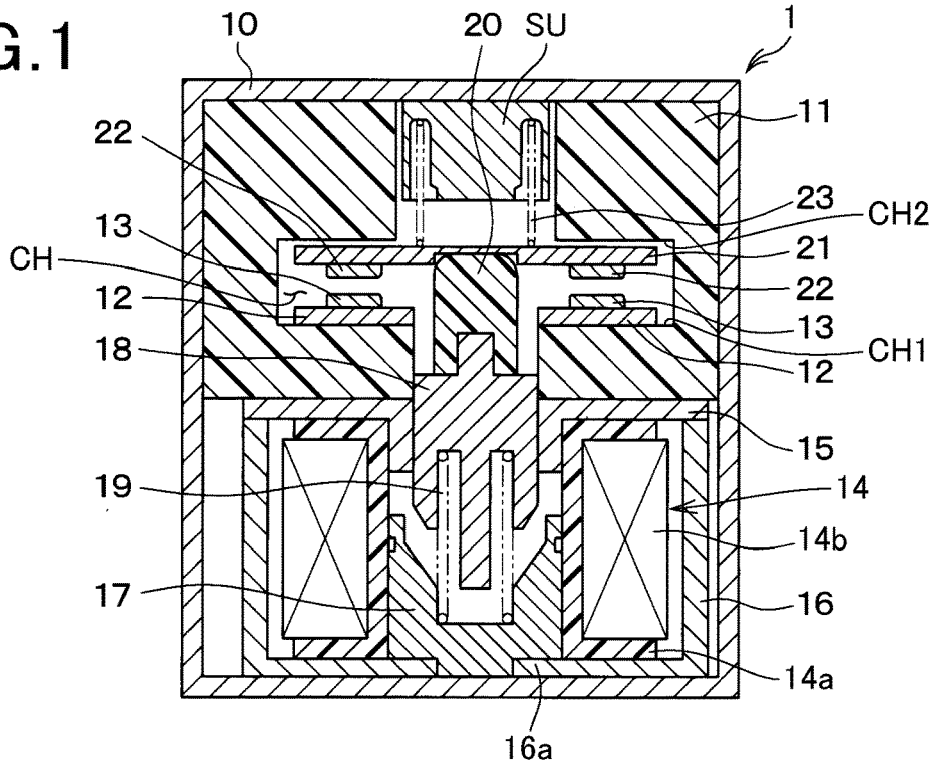
FIG. 1 is an axial cross sectional view of an electromagnetic relay including an electromagnetic driver according to the first embodiment of the present disclosure.

The following describes embodiments of the present disclosure with reference to the accompanying drawings. In the embodiments, like parts between the embodiments, to which like reference characters are assigned, are omitted or simplified to avoid redundant description.

First Embodiment

The following describes the first embodiment of the present disclosure.

Figure 2:
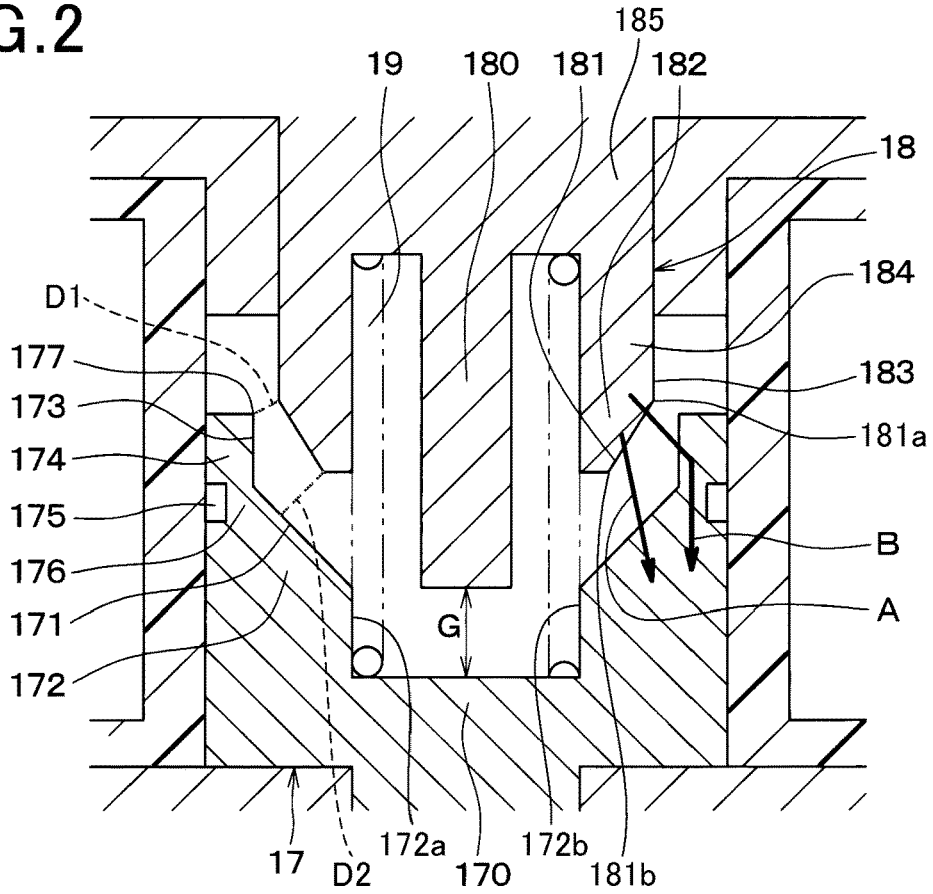
FIG. 2 is an enlarged axial cross section view schematically illustrating the principal components of the electromagnetic relay illustrated in FIG. 1 while a gap is within a large range.
Figure 3:
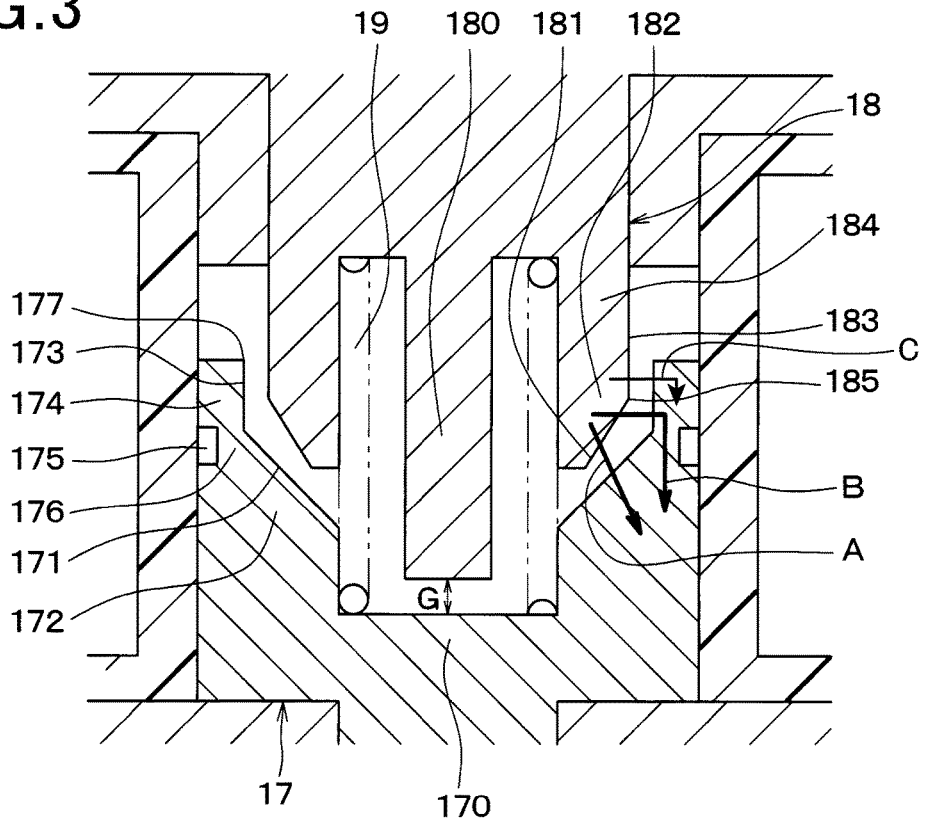
FIG. 3 is an enlarged axial cross section view schematically illustrating the principal components of the electromagnetic relay illustrated in FIG. 1 while the gap is within a small range.

Referring to FIGS. 1 to 3, an electromagnetic relay 1 includes a case 10, which is made of, for example, a resin material. The case 10 has, for example, a substantially cylindrical shape. The electromagnetic relay 1 also includes a base 11 and other components described later, which are installed in the case 10. The base 11 is made of, for example, a resin material, such as nylon, and has, for example, a substantially annular cylindrical shape with an inner cylindrical hollow space. For example, the case 10 has a first circular wall and a second circular wall in its axial direction, which respectively constitute a top circular wall and a bottom circular wall.

For example, the base 11, which has opposing first and second ring end surfaces in its axial direction, is disposed in, for example, a substantially upper space of the case 10 while the first annular end surface is mounted on the inner surface of the first circular wall of the case 10.

The base 11 has formed therein a cylindrical inner hollow chamber CH communicating with the inner cylindrical hollow space. That is, the inner hollow chamber CH has a predetermined axial length, and extends radially outward from the inner cylindrical hollow space. Specifically, the inner hollow chamber CH has an annular bottom surface CH1 and an annular top surface CH2 opposite to the annular bottom surface CH1 in its axial direction.

The electromagnetic relay 1 includes a pair of stationary members 12, each of which is, for example, an electrically conductive plate, mounted on the annular bottom surface CH1 of the inner hollow chamber CH. The stationary members 12 are connected to an unillustrated external electrical circuit via unillustrated lead wires or other similar connection members.

The electromagnetic relay 1 includes a pair of stationary contacts 13 each made of an electrical conductive member. The stationary contacts 13 are swaged on the respective stationary members 12.

The electromagnetic relay 1 includes a substantially circular plate-like movable member 21 made of an electrical conductive material, such as metal. The movable member 21, which has opposing first and second surfaces, is installed in the inner hollow chamber CH to be movable in the axial direction of the inner hollow chamber CH.

The electromagnetic relay 1 includes, for example, a pair of movable contacts 22 each made of an electrical conductive member. The movable contacts 22 are swaged on the first surface of the movable member 21 to face the respective stationary contacts 13.

The electromagnetic relay 1 includes a spring support SU mounted on the inner surface of the first circular wall of the case 10. The electromagnetic relay 1 also includes a contact pressure spring 23 having opposing first and second ends in its axial direction. The first end of the contact pressure spring 23 is mounted to the spring support SU, and the second end of the contact pressure spring 23 is mounted to the movable member 21. That is, the contact pressure spring 23 urges, i.e. biases, the movable member 21 toward the stationary members 12.

In addition, the electromagnetic relay 1 includes a substantially annular cylindrical coil assembly 14 that is, for example, disposed in a substantially lower space of the case 10 to be coaxial to the movable member 21, i.e. the contact pressure spring 23, with a space with respect to the second annular end surface of the base 11. The coil assembly 14 includes a substantially annular cylindrical bobbin 14*a* and a substantially annular cylindrical coil 14*b* wound around the outer circumferential surface of the bobbin 14*a*. The coil 14*b* is configured to produce a magnetic field when energized.

The electromagnetic relay 1 includes a substantially annular plate 15 disposed in the space between the coil assembly 14 and the base 11. The plate 15 has a hollow cylindrical flange extending from the inner periphery thereof toward the second circular wall of the case 10.

The lower space of the case 10 includes a radially inner space and a radially outer space partitioned by the coil assembly 14.

The electromagnetic relay 1 includes a substantially cylindrical yoke 16 installed in the radially outer space of the lower space of the case 10. The yoke 16 has a substantially annular circular bottom 16*a* and an opening top. The bottom 16*a* includes a through hole at its center. The yoke 16 is mounted at its bottom on the inner surface of the second circular wall of the case 10 to be coaxial to the movable member 21, i.e. the contact pressure spring 23. That is, the yoke 16 has a substantially U shape in its axial cross section. The coil assembly 14 is mounted on the bottom of the yoke 16 so as to be coaxially installed in the yoke 16.

The electromagnetic relay 1 includes a substantially cylindrical stationary core 17 made of, for example, a ferromagnetic metal. The stationary core 17 is installed in the radially inner space of the lower space of the case 10. The stationary core 17 includes a circular bottom 170 with a projection extending outwardly from the center of the bottom 170. The stationary core 17 is mounted at its bottom 170 on the bottom 16*a* of the yoke 16 while the projection of the bottom 170 is fitted in the through hole of the bottom 16*a* of the yoke 16. That is, the stationary core 17 is fitted in the lower portion of the inner periphery of the coil assembly 14, i.e. the bobbin 14*a*.

The structure of the stationary core 17 will be described in detail below.

The electromagnetic relay 1 includes a substantially cylindrical movable core 18 made of, for example, a ferromagnetic metal. The movable core 18 is installed in the radially inner space of the lower space of the case 10 to face the stationary core 17. The movable core 18 is fitted in the hollow cylindrical flange of the plate 15 to be slidable, i.e. movable, in the axial direction of the plate 15, i.e. the coil assembly 14.

The structure of the movable core 18 will be described in detail below.

The electromagnetic relay 1 includes a return spring 19 sandwiched between the stationary core 17 and the movable core 18. The return spring 19 urges, i.e. biases, the movable core 18 to be away from the stationary core 17. When the coil 14*b* is energized, the stationary core 17 is excited based on magnetic flux of the magnetic field generated by the coil 14*b*, and the excited stationary core 17 magnetically pulls, i.e. attracts, the movable core 18 against the urging force of the return spring 19.

That is, the movable core 18 is configured to be reciprocably movable in its axial direction, i.e. the axial direction of the stationary core 17 and the coil 14*b*; the axial direction corresponds to the vertical direction in FIG. 1.

Hereinafter, the direction of the movable core 17 in which the movable core 17 is reciprocable will also be referred to as a movable-core reciprocating direction. In addition, the direction of the movable core 17 substantially perpendicular to the movable-core reciprocating direction will also be referred to as a movable-core radial direction.

Note that the plate 15, yoke 16, stationary core 17, and movable core 18 constitute a magnetic circuit through which the magnetic flux generated by the coil 14 flows.

The electromagnetic relay 1 includes a substantially cylindrical insulator 20 made of, for example, resin with high electrical insulation property. The insulator 20 is removably mounted on the center portion of the first surface of the movable member 21. The movable core 18 has first and second circular ends in its axial direction. The insulator 20 is provided to face the first circular end of the movable core 18, and is mounted to the first end of the movable core 18.

Referring to FIG. 2, the substantially cylindrical stationary core 17 has an outer circumferential surface, and is installed in the bobbin 14*a* while the outer circumferential surface of the stationary core 17 is in contact with the inner circumferential surface of the bobbin 14*a*.

The stationary core 17 includes a taper portion 172 and a cylindrical portion 174.

The bottom 170 is the farthest member relative to the movable core 18, and the taper portion 172 coaxially extends from the bottom 170 toward the movable core 18. The taper portion 172 has a first annular inner surface 172*a*, and an annular taper inner surface 171 coaxially continuing from the first annular inner surface 172*a*. The first annular inner surface 172*a* has a constant inner diameter, and the annular taper inner surface 171 has an inner diameter that becomes greater toward the movable member 21.

The annular taper inner surface 171 has a first edge continuing to the first annular inner surface 172*a*, and a second edge opposite to the first edge. The cylindrical portion 174 has a second annular inner surface 173 coaxially continuing from the second edge of the annular taper inner surface 171. The second annular inner surface 173 has a constant inner diameter larger than the constant inner diameter of the first annular inner surface 172*a*.

The second annular inner surface 173 has an edge 177.

That is, the annular taper inner surface 171 is tapered toward the bottom 170 while the inner diameter of the annular taper inner surface 171 becomes narrower toward the bottom 170.

The stationary core 17 also includes an annular groove 175 provided to the outer circumferential surface thereof. The annular groove 175 is located to face the boundary between the taper portion 172 and the cylindrical portion 174. This arrangement enables a magnetic flux limiter, i.e. a magnetic flux aperture, 176 between the annular groove 175 and the boundary between the taper portion 172 and the cylindrical portion 174. That is, the magnetic flux limiter 176 is comprised of a narrowed annular magnetic path having a radial cross section that is smaller than a radial cross section of the cylindrical portion 174 and a radial cross section of the taper portion 172. When exited, the magnetic flux limiter 176 enables magnetic saturation to occur therethrough when the dimension, i.e. the size, of a gap G described later is equal to or smaller than a predetermined dimension, i.e. size.

The movable core 18 includes a substantially cylindrical base 185, an annular projection 184, an annular groove 186, and a cylindrical bar stopper 180.

The cylindrical base 185 has a first circular end corresponding to the first circular end of the movable core 18, and a second circular end opposite to the first circular end thereof. The annular projection 184 projects from the outer periphery of the second circular end of the cylindrical base 185 toward the taper portion 172 of the stationary core 17.

The bar stopper 180 also projects from the center of the second circular end of the cylindrical base 185 toward the bottom 170 of the stationary core 17 to be longer than the annular projection 184. This enables the annular groove 186 to be provided between the bar stopper 180 and the annular projection 184. The return spring 19 is installed around the bar stopper 180 in the annular groove 186 to be sandwiched between the cylindrical base 185 and the bottom 170 of the stationary core 17.

The annular projection 184 has an outer circumferential surface 183 having a constant outer diameter, and include at its projecting end a taper portion 182 having an annular taper surface 181. The annular taper surface 181 extends continuously from the outer circumferential surface 183 to be tapered toward the annular taper inner surface 171 of the taper portion 172 of the stationary core 170.

The stationary core 17 and the movable core 18 are arranged to provide the gap G between the projecting end surface of the bar stopper 180 and the bottom 170, i.e. an inner surface of the bottom 170 upon no energization of the coil 14*b*.

When the movable core 18 is pulled to the stationary core 17 on energization of the coil 14*b*, the bar stopper 180 of the movable core 18 is abutted onto the bottom 170 of the stationary core 17, resulting in movement of the movable core 18 being restricted. Thereafter, the movable core 18 is separated from the bottom 170 of the stationary core 17 by the return spring 19 on de-energization of the coil 14*b*. The length, i.e. size, of the gap G between the projecting end surface of the bar stopper 180 and the bottom 170 in the reciprocation direction of the movable core 18 will be referred to as the dimension of the gap G or gap dimension G.

That is, the gap dimension G has a maximum value when the movable core 18 is located at an original position while the coil 14 is deenergized. In other words, the movable core 18 is configured to start to move toward the stationary core 17 from the original position at which the gap dimension G has the maximum value.

The taper surface 182 has an outer diameter that becomes smaller toward the annular taper inner surface 171 of the taper portion 172.

As compared with conventional electromagnetic relays, the electromagnetic relay 1 includes the cylindrical portion 174 whose axial length is longer than the corresponding axial length of the cylindrical portion of each conventional electromagnetic relay. This enables the clearance between the second annular inner surface 173 of the stationary core 17 and the annular taper surface 181 of the movable core 18 to be narrower than the clearance between the second annular inner surface of the stationary core and the taper surface of the movable core of each conventional electromagnetic relay.

The edge 177 of the second annular inner surface 173 is located to be substantially radially adjacent to the annular taper surface 181 of the movable core 18 when the gap dimension G has the maximum value. When the gap dimension G has the maximum value, a first minimum distance D1 is shorter than a second minimum distance D2. The first minimum distance D1 is defined as a minimum distance between the second annular inner surface 173 and the annular taper surface 181, i.e. between the edge 177 of the second annular inner surface 173 and a first edge 181*a* of the annular taper surface 181, which faces the edge 177. The second minimum distance D2 is defined as a minimum distance between the annular taper inner surface 171 and the taper surface 181, i.e. between the annular taper inner surface 171 and a second edge 181*b*, which is opposite to the first edge 181*a*.

Next, the following describes how the electromagnetic relay 1 is operated.

When the coil 14 is energized, electromagnetic attractive force, i.e. pulling force, is generated between the movable core 18 and the stationary core 17. This causes the movable core 18 and the insulator 20 to be pulled to the stationary core 17 against the urging force of the return spring 19. This causes the movable member 21 mounted to the insulator 20 to move toward the stationary member 12 while being biased by the urging force of the contact pressure spring 23. This enables the movable contacts 22 to be abutted onto the respective stationary contacts 13, resulting in electrical conduction between the stationary contacts 13 via the movable contacts 22 and the movable member 21. Note that the movable core 18 and the insulator 20 move toward the stationary core 17 after abutment of the movable contacts 22 on the corresponding stationary contacts 13, resulting in the insulator 20 being separated from the movable contacts 21.

In contrast, when the coil 14 is deenergized, the return spring 19 urges the movable core 18, the insulator 20, and the movable member 21 to move them to the direction, which is an anti-stationary-core direction, opposite to the direction toward the stationary core 17 against the urging force of the contact pressure spring 23. This causes the movable contacts 22 to be separated from the corresponding stationary contacts 13, resulting electrical isolation between the pair of stationary contacts 13.

Figure 4:
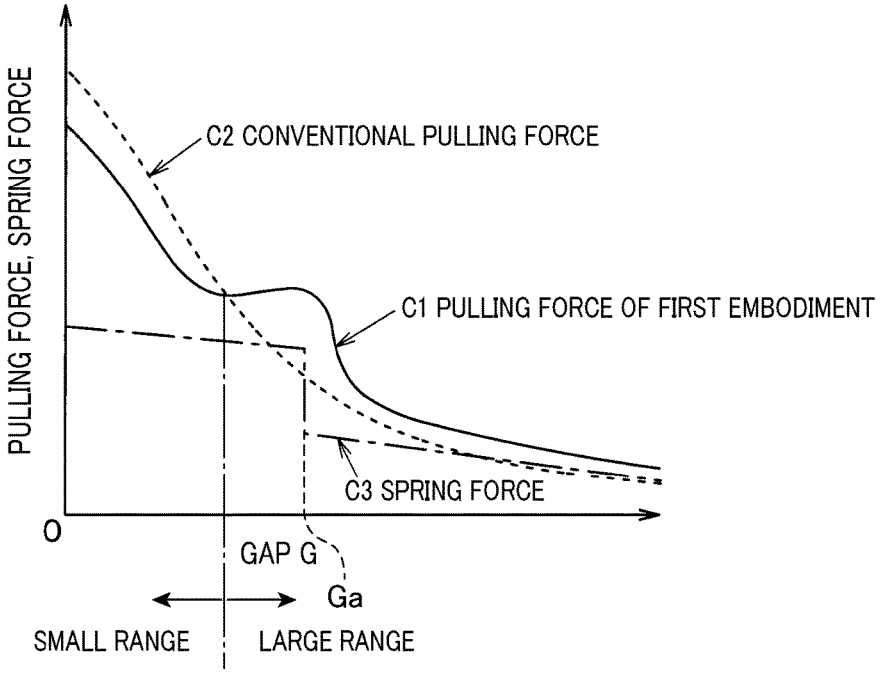
FIG. 4 is a graph schematically illustrating axial pulling-force characteristics of the electromagnetic relay illustrated in FIG. 1 as compared with conventional pulling-force characteristics of a conventional electromagnetic relay.

Next, the following describes how magnetic flux flows when the coil 14*b* is energized with reference to FIGS. 2 to 4. Note that, in the following description, pulling force that pulls the movable core 18 in the axial direction of the stationary core 17, i.e. the reciprocation direction of the movable core 18, will be referred to as axial pulling force. In addition, in the following description, pulling force that pulls the movable core 18 in a radial direction of the stationary core 17, i.e. radially pulls the movable core 18, will be referred to as radial pulling force. The radial direction is perpendicular to the reciprocation direction, i.e. axial direction, of the movable core 18.

FIG. 4 illustrates how the axial pulling force is changed depending on change of the dimension of the gap G as PULLING FORCE OF FIRST EMBODIMENT using a solid curve with reference character C1 according to the firs embodiment. As described above, FIG. 4 also illustrates axial pulling force of the conventional electromagnetic relay depending on change of the dimension of the gap G as CONVENTIONAL PULLING FORCE using a dashed curve with reference character C2. FIG. 4 further illustrates the resultant force of the urging force of the return spring 19 and the urging force of the contact pressure spring 23 as SPRING FORCE using a dot-and-dash curve with reference character C3.

As described above, when the coil 14*b* is deenergized, i.e. when the gap dimension G has the maximum value, the edge 177 of the second annular inner surface 173 is located to be substantially radially adjacent to the annular taper surface 181 of the movable core 18. In addition, the first minimum distance D1 between the edge 177 of the second annular inner surface 173 and the first edge 181*a* of the annular taper surface 181 is shorter than the second minimum distance D2 between the annular taper inner surface 171 and the second edge 181*b* of the annular taper surface 181.

Referring to FIG. 2, when energization of the coil 14*b* is started, a first magnetic flux component induced by the coil 14*b* flows from the annular taper surface 181 to the annular taper inner surface 171 while bypassing the cylindrical portion 174 and the magnetic flux limiter 176 as illustrated by arrow A, and a second magnetic flux component induced by the coil 14*b* flows from the taper surface 181 to the second annular inner surface 173.

The first magnetic flux component, which has flowed from the annular taper surface 181 to the annular taper inner surface 171 while has bypassed the cylindrical portion 174 and the magnetic flux limiter 176, flows through the taper portion 172 to the yoke 16. The magnetic circuit including the taper portion 182, the taper portion 172, and the yoke 16 through which the first magnetic flux component flows while bypassing the cylindrical portion 174 and the magnetic flux limiter 176 will be referred to as a main magnetic circuit.

On the other hand, the second magnetic flux component, which has flowed from the annular taper surface 181 to the second annular inner surface 173, flows to the yoke 16 through the cylindrical portion 174, the magnetic flux limiter 176, and the taper portion 172. The magnetic circuit including the taper portion 182, the cylindrical portion 174, the magnetic flux limiter 176, the taper portion 172, and the yoke 16 through which the second magnetic flux component flows will be referred to as an auxiliary magnetic circuit.

When the gap dimension G has the maximum value, the minimum distance D1 between the edge 177 of the second annular inner surface 173 and the first edge 181*a* of the annular taper surface 181 is shorter than the second minimum distance D2 between the annular taper inner surface 171 and the second edge 181*b* of the taper surface 181. For this reason, as illustrated by the arrow B, magnetic flux flowing through a first clearance between the second annular surface 173 and the annular taper surface 181 easier than magnetic flux flowing through a second clearance between the annular taper surface 181 and the annular taper inner surface 171.

This results in the axial pulling force generated by the second magnetic flux component flowing through the auxiliary magnetic circuit mainly pulling the movable core 18 to the bottom 170 of the stationary core 17.

Thereafter, as the movable core 18 moves to the stationary core 17, the second clearance between the annular taper surface 181 and the annular taper inner surface 171 becomes narrower. This causes the axial pulling force generated by the first magnetic flux component flowing through the main magnetic circuit to increase in a substantially quadratic curve. The axial pulling force generated by the first magnetic flux component flowing through the main magnetic circuit according to the electromagnetic relay 1 however decreases as compared with the axial pulling force generated by the first magnetic flux component flowing through the main magnetic circuit according to the conventional electromagnetic relay. This is because the axial pulling force according to the electromagnetic relay 1 is smaller than the axial pulling force according to the conventional electromagnetic relay by the second magnetic flux component flowing through the auxiliary magnetic circuit.

As illustrated in FIG. 4, when the gap dimension G is sufficiently wide, although the axial pulling force according to the electromagnetic relay 1 is smaller than the axial pulling force according to the conventional electromagnetic relay, it is possible to increase the total pulling force composed of the axial pulling force generated by the main magnetic circuit and the axial pulling force generated by the auxiliary magnetic circuit to be greater than the axial pulling force according to the conventional electromagnetic relay (see FIG. 4).

Additionally, the first clearance between the second annular surface 173 and the annular taper surface 181 when the gap dimension G according to the electromagnetic relay 1 is maximized is shorter than the first clearance between the second annular surface and the annular taper surface when the gap dimension according to the conventional electromagnetic relay is maximized. For this reason, the electromagnetic relay 1 enables the axial pulling force with the gap dimension G being maximized to increase than the axial pulling force of the conventional electromagnetic relay with the gap dimension G being maximized.

When the first edge 181*a* of the annular taper surface 181, which serves as the boundary between the annular taper surface 181 and the outer circumferential surface 183, and the edge 177 of the second annular inner surface 173 are radially overlapped with each other, the axial pulling force generated by the auxiliary magnetic circuit becomes maximum.

From this viewpoint, the electromagnetic relay 1 is configured such that, when the gap dimension G is located at a predetermined size Ga or thereabout at which the resultant force of the urging force of the return spring 19 and the urging force of the contact pressure spring 23 rapidly increases, the first edge 181*a* of the annular taper surface 181, which serves as the boundary between the annular taper surface 181 and the outer circumferential surface 183, and the edge 177 of the second annular inner surface 173 are radially overlapped with each other (see FIG. 4). This enables the axial pulling force generated by the auxiliary magnetic circuit to become maximum when the resultant force of the urging force of the return spring 19 and the urging force of the contact pressure spring 23 rapidly increases. This enables the axial pulling force, which is greater than the resultant force of the urging force of the return spring 19 and the urging force of the contact pressure spring 23, to be easily obtained even at the time when the resultant force rapidly increases.

Referring to FIG. 3, when the gap dimension G is reduced as the movable core 18 is pulled to the stationary core 17, the first magnetic flux component induced by the coil 14*b* flows from the annular taper surface 181 to the annular taper inner surface 171 while bypassing the cylindrical portion 174 and the magnetic flux limiter 176 as illustrated by arrow A.

In particular, because the outer circumferential surface 183 and the second annular inner surface 173 are radially overlapped with each other, the second magnetic flux component induced by the coil 14*b* flows from the taper surface 181 to the second annular inner surface 173 as illustrated by arrow B, and a third magnetic flux component flows from the outer circumferential surface 183 to the second annular inner surface 173 as illustrated by arrow C (see FIG. 3).

The first magnetic flux component, which has flowed from the annular taper surface 181 to the annular taper inner surface 171 while has bypassed the cylindrical portion 174 and the magnetic flux limiter 176, flows through the taper portion 172 to the yoke 16.

As the gap dimension G becomes smaller, the second clearance between the annular taper surface 181 and the annular taper inner surface 171 becomes narrower. This causes the axial pulling force generated by the first magnetic flux component flowing through the main magnetic circuit to the yoke 16 to increase.

On the other hand, the second magnetic flux component, which has flowed from the annular taper surface 181 to the second annular inner surface 173, flows to the yoke 16 through the auxiliary magnetic circuit including the cylindrical portion 174, the magnetic flux limiter 176, and the taper portion 172. Similarly, the third magnetic flux component, which has flowed from the outer circumferential surface 183 to the second annular inner surface 173, flows to the yoke 16 through the auxiliary magnetic circuit.

As illustrated by arrows B and C, the vector of each of the second magnetic flux component flowing from the annular taper surface 181 to the second annular inner surface 173 and the third magnetic flux component flowing from the outer circumferential surface 183 to the second annular inner surface 173 gradually comes close to a radial direction of the stationary core 17 from the axial direction of the stationary core 17, resulting in an increase of the radial pulling force. That is, the axial pulling force generated by the magnetic flux components flowing through the auxiliary magnetic circuit when the gap dimension G is within a small range is smaller than the axial pulling force generated by the magnetic flux components flowing through the auxiliary magnetic circuit when the gap dimension G is within a large range larger than the small range.

While the gap dimension G is within the small range, the axial pulling force generated by the first magnetic flux component flowing through the main magnetic circuit becomes greater as the gap dimension G becomes smaller, but the axial pulling force generated by the second and third magnetic flux components flowing through the auxiliary magnetic circuit becomes smaller as the gap dimension G becomes smaller. This results in the total axial pulling force generated by the electromagnetic relay 1 being smaller than the total axial pulling force generated by the conventional electromagnetic relay.

While the gap dimension G is within the small range, the amount of magnetic flux passing through the first clearance between the second annular surface 173 and the annular taper surface 181 and passing through a third clearance between the second annular surface 173 and the outer circumferential surface 183 would increase.

From this viewpoint, the electromagnetic relay 1 according to the first embodiment includes the magnetic flux limiter 176 that enables magnetic saturation through the magnetic flux limiter 176 to occur when the gap dimension G is equal to or smaller than the predetermined dimension. That is, the magnetic flux limiter 176 limits the amount of magnetic flux passing through the auxiliary magnetic circuit when the gap dimension G is equal to or smaller than the predetermined dimension. In addition, even if the gap dimension G is close to or larger than the predetermined dimension so that no magnetic saturation occurs in the magnetic flux limiter 176, an increase of the amount of magnetic flux passing through the magnetic flux limiter 176 increases the magnetic resistance across the magnetic flux limiter 176. This also limits the magnetic flux flowing through the auxiliary magnetic circuit.

Accordingly, limiting the magnetic flux flowing through the auxiliary magnetic circuit enables the amount of magnetic flux flowing through the main magnetic circuit to increase, thus increasing the axial pulling force generated by the magnetic flux flowing through the main magnetic circuit.

As described above, the electromagnetic relay 1 according to the first embodiment includes the auxiliary magnetic circuit in addition to the main magnetic circuit; the auxiliary magnetic circuit enables an additional magnetic path for magnetic flux generated by the coil 14*b* to be established in addition to the magnetic path, which is generated by the main magnetic circuit, for the magnetic flux generated by the coil 14*b*.

This therefore achieves a first advantageous effect of resulting in an increase of the axial pulling force when the gap dimension G is within the large range.

The electromagnetic relay 1 includes the magnetic flux limiter 176 that limits the magnetic flux flowing through the auxiliary magnetic circuit. This configuration achieves a second advantageous effect of preventing a large decrease of the axial pulling force generated by the magnetic flux flowing through the main magnetic circuit.

The electromagnetic relay 1 is configured such that the axial pulling force generated by the magnetic flux flowing through the auxiliary magnetic circuit becomes maximum when the gap dimension G is located at a predetermined size Ga or thereabout at which the resultant force of the urging force of the return spring 19 and the urging force of the contact pressure spring 23 rapidly increases.

This configuration achieves a third advantageous effect of enabling the axial pulling force, which is greater than the resultant force of the urging force of the return spring 19 and the urging force of the contact pressure spring 23, to be easily obtained even if the resultant force rapidly increases.

Figure 5:
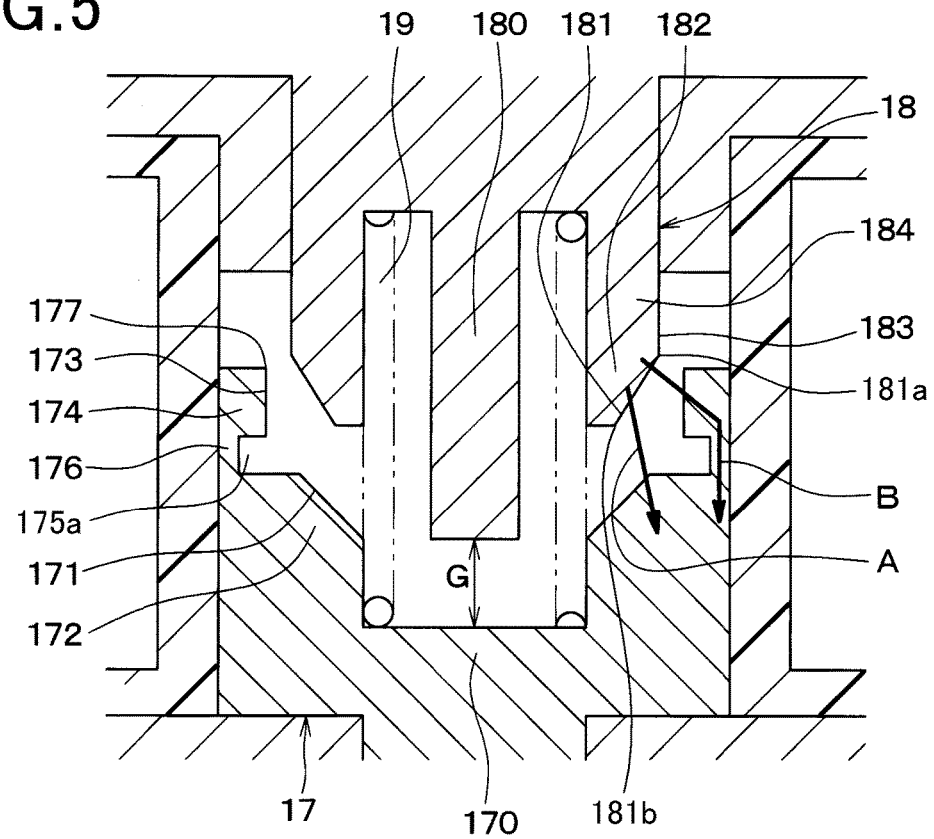
FIG. 5 is an enlarged axial cross section view schematically illustrating the principal components of a modification of the electromagnetic relay according to the first embodiment.

Note that the annular groove 175 according to the first embodiment is mounted to the outer circumferential surface of the stationary core 17, but an annular groove 175*a* can be mounted to an inner circumferential surface of the stationary core 17, for example, to the boundary between the second annular inner surface 173 and the annular taper inner surface 171 (see FIG. 5).

Second Embodiment

Figure 6:
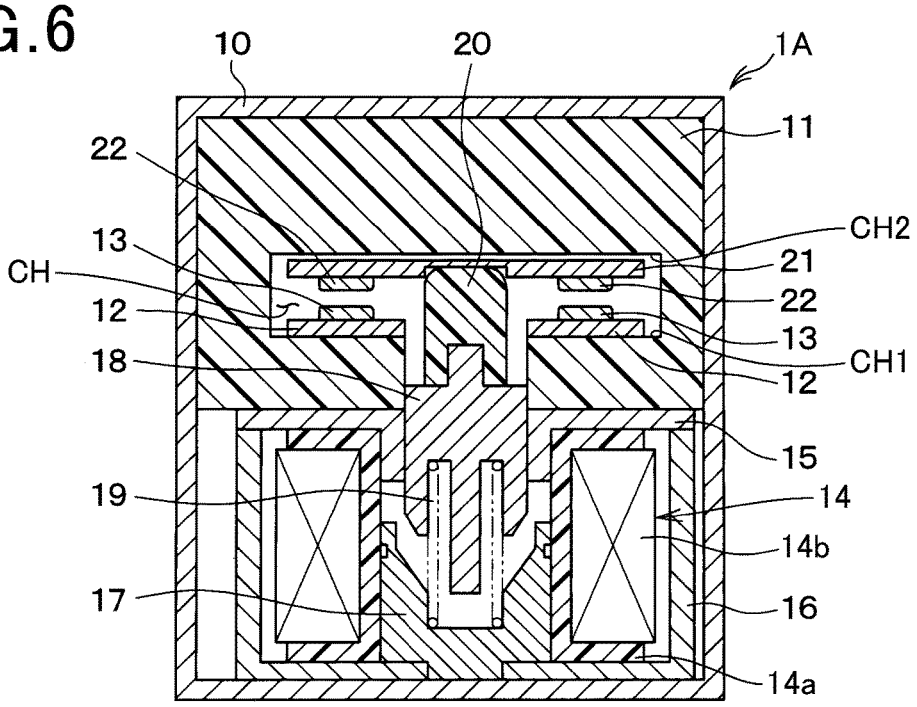
FIG. 6 is an axial cross sectional view of an electromagnetic relay including an electromagnetic driver according to the second embodiment of the present disclosure.
Figure 7:
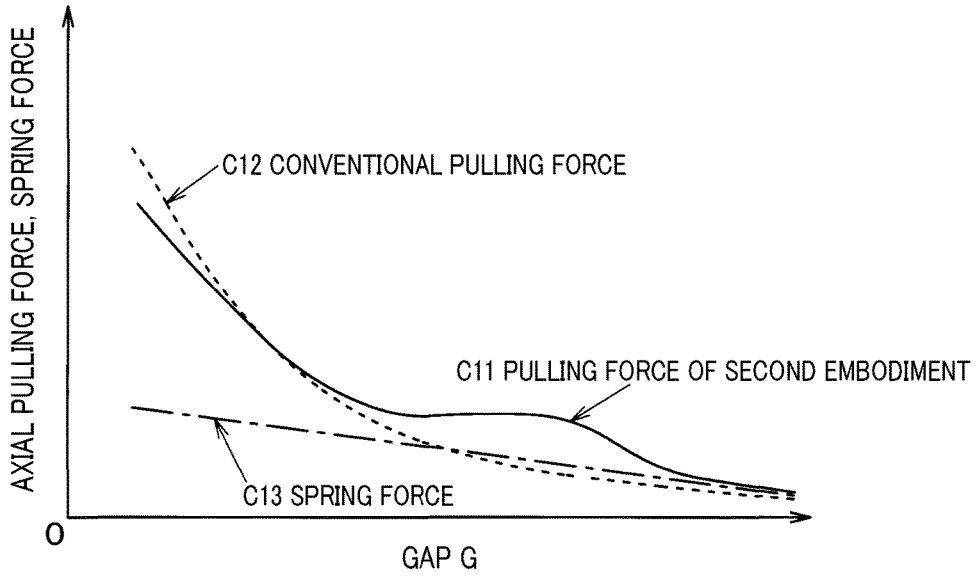
FIG. 7 is a graph schematically illustrating axial pulling-force characteristics of the electromagnetic relay illustrated in FIG. 6 as compared with the conventional pulling-force characteristics of the conventional electromagnetic relay.

The following describes the second embodiment of the present disclosure with reference to FIGS. 6 and 7. The second embodiment differs from the first embodiment in the following points. So, the following mainly describes the different points, and omits or simplifies descriptions of like parts between the first and second embodiments, to which identical or like reference characters are assigned, thus eliminating redundant description.

Referring to FIG. 6, an electromagnetic relay 1A is configured such that (1) The base 11 has a substantially annular cylindrical shape without an inner cylindrical hollow space (2) The contact pressure spring 23 and the spring support 23 has been eliminated from the electromagnetic relay 1 according to the first embodiment In addition, the insulator 20 is fixedly mounted on the center portion of the first surface of the movable member 21. This enables the insulator 20 and the movable member 21 to move together.

Next, the following describes how the electromagnetic relay 1 is operated.

When the coil 14*b* is energized, electromagnetic attractive force, i.e. pulling force, is generated between the movable core 18 and the stationary core 17. This causes the movable core 18, the insulator 20, and the movable member 21 to be pulled to the stationary core 17 against the urging force of the return spring 19. This enables the movable contacts 22 to be abutted onto the respective stationary contacts 13, resulting in electrical conduction between the stationary contacts 13 via the movable contacts 22 and the movable member 21. When the movable contacts 22 are abutted onto the respective stationary contacts 13, movement of the movable core 18, the insulator 20, and the movable member 21 is stopped.

In contrast, when the coil 14*b* is deenergized, the return spring 19 urges the movable core 18, the insulator 20, and the movable member 21 to move them toward the anti-stationary-core direction opposite to the direction toward the stationary core 17. This causes the movable contacts 22 to be separated from the corresponding stationary contacts 13, resulting electrical isolation between the pair of stationary contacts 13.

FIG. 7 illustrates how the axial pulling force is changed depending on change of the dimension of the gap G as PULLING FORCE OF SECOND EMBODIMENT using a solid curve with reference character C11 according to the second embodiment. FIG. 7 also illustrates axial pulling force of the conventional electromagnetic relay depending on change of the dimension of the gap G as CONVENTIONAL PULLING FORCE using a dashed curve with reference character C12. FIG. 7 further illustrates the urging force of the return spring 19 as SPRING FORCE using a dot-and-dash curve with reference character C13.

As illustrated in FIG. 7, the spring urging force of the return spring 19 linearly increases without rapid change as the gap dimension G decreases, because the contact pressure spring 23 has been eliminated from the electromagnetic relay 1A. How the axial pulling force according to the second embodiment is changed is substantially identical to how the axial pulling force according to the first embodiment is changed.

Because the axial pulling force according to the second embodiment is substantially identical to the axial pulling force according to the first embodiment, the electromagnetic relay 1A according to the second embodiment achieves the first and second advantageous effects

Third Embodiment

Figure 8:
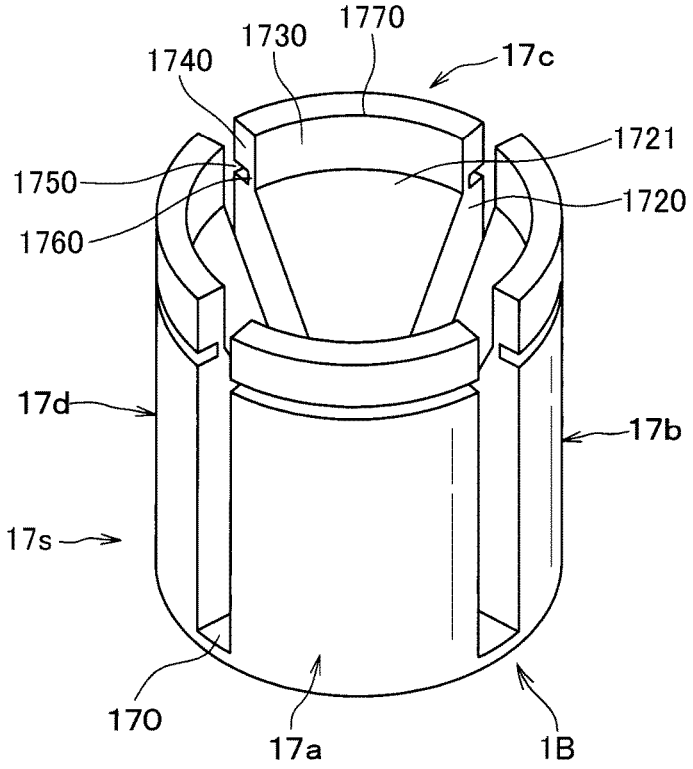
FIG. 8 is a perspective view schematically illustrating the principal components of an electromagnetic relay according to the third embodiment of the present disclosure.
Figure 9:
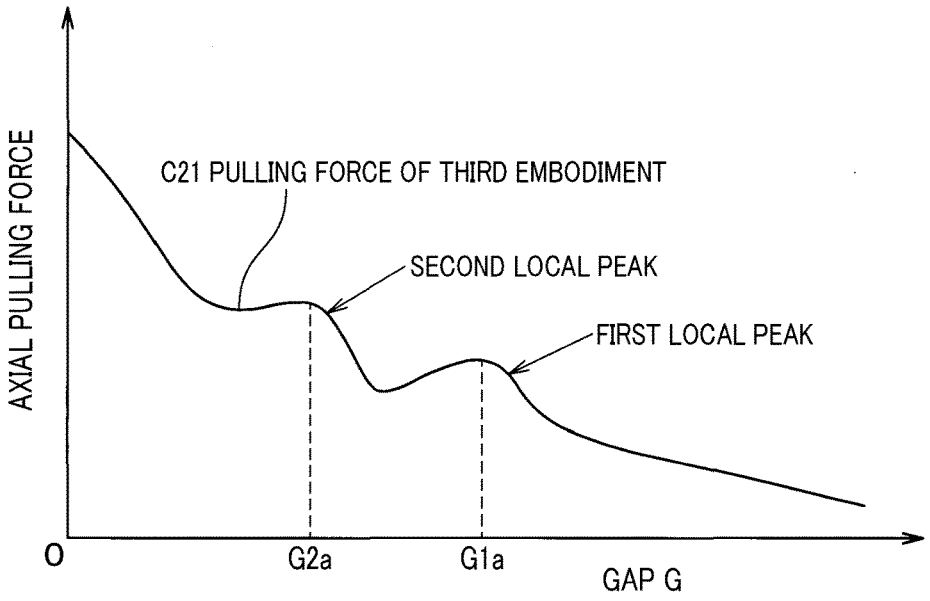
FIG. 9 is a graph schematically illustrating axial pulling-force characteristics of the electromagnetic relay illustrated in FIG. 8.

The following describes the third embodiment of the present disclosure with reference to FIGS. 8 and 9. The third embodiment differs from the first embodiment in the following points. So, the following mainly describes the different points, and omits or simplifies descriptions of like parts between the first and third embodiments, to which identical or like reference characters are assigned, thus eliminating redundant description.

Referring to FIG. 8, an electromagnetic relay 1B includes a stationary core 17S, and the stationary core 17S includes the circular bottom 170 and a core assembly comprised of first to fourth core segments 17*a* to 17*d* extending from the bottom 170 in the axial direction of the bottom 170.

The first to fourth core segments 17*a* to 17*d* are arranged in a circumferential direction of the bottom 170 with regular intervals thereamong in this order in the counterclockwise direction.

Each of the first to fourth core segments 17*a* to 17*d* has a first end continuously joined to the outer periphery of the bottom 170, and a free second end.

Each of the first to fourth core segments 17*a* to 17*d* has a substantially partially cylindrical shape, and the core assembly of the first to fourth core segments 17*a* to 17*d* constitutes a substantially cylindrical shape. That is, the first and third core segments 17*a* and 17*c* are arranged to face each other, and the second and fourth core segments 17*b* and 17*d* are arranged to face each other.

Each of the first to fourth core segments 17*a* to 17*d* includes a taper portion 1720 and a partially cylindrical portion 1740. The taper portion 1720 axially extends from the bottom 170 toward the movable core 18. The taper portion 1720 has a first inner surface, and a taper inner surface 1710 axially continuing from the first inner surface. The first inner surface has a circumferentially constant width, and the taper inner surface 1710 has a circumferential width that becomes greater toward the movable core 18.

The taper inner surface 1710 has a first edge continuing to the first inner surface, and a second edge opposite to the first edge. The cylindrical portion 1740 has a second inner surface 1730 axially continuing from the second edge of the taper inner surface 1710. The second inner surface 1730 has a circumferentially constant width larger than the circumferentially constant width of the first inner surface.

The second inner surface 1730 has an edge 1770.

That is, the taper inner surface 1710 is tapered toward the bottom 170 while the circumferential width of the taper inner surface 1710 becomes narrower toward the bottom 170.

Each of the first to fourth core segments 17*a* to 17*d* also includes an annular groove 1750 provided to the outer circumferential surface thereof. The annular groove 1750 is located to face the boundary between the taper portion 1720 and the cylindrical portion 1740. This arrangement enables a magnetic flux limiter, i.e. a magnetic flux aperture, 1760 between the annular groove 1750 and the boundary between the taper portion 1720 and the cylindrical portion 1740. That is, the magnetic flux limiter 1760 is comprised of a narrowed annular magnetic path having a radial cross section that is smaller than a radial cross section of the cylindrical portion 1740 and a radial cross section of the taper portion 1720. When excited, the magnetic flux limiter 1760 enables magnetic saturation to occur therethrough when the dimension, i.e. the size, of a gap G described later is equal to or smaller than a predetermined dimension, i.e. size.

The edge 1770 of each of the first to fourth core segments 17*a* to 17*d* serves as a moving head thereof in the anti-stationary core direction in which the movable core 18 moves based on the urging force of the return spring 19 (see FIG. 1) while the coil 14*b* is deenergized.

Next, the following describes the position of the edge 1770 of each of the first to fourth core segments 17*a* to 17*d* in the reciprocation direction, i.e. the axial direction, of the movable core 18.

The position of the edge 1770 of the first core segment 17*a* is substantially identical to the position of the edge 1770 of the third core segment 17*c* in the reciprocation direction of the movable core 18. Similarly, the position of the edge 1770 of the second core segment 17*b* is substantially identical to the position of the edge 1770 of the fourth core segment 17*d* in the reciprocation direction of the movable core 18.

In particular, the edges 1770 of the first and third core segments 17*a* and 17*c* are located to be closer to the movable member 21 than the edges 1770 of the second and fourth core segments 17*b* and 17*d* to the movable member 21. That is, the is a variation between the axial positions of the edges 1770 of the first and third core segments 17*a* and 17*c* and the axial positions 1770 of the second and fourth core segments 17*b* and 17*d*. In other words, the axial positions of the edges 1770 of the first and third core segments 17*a* and 17*c* are different from the axial positions of the edges 1770 of the second and fourth core segments 17*b* and 17*d*.

FIG. 9 illustrates how the axial pulling force is changed depending on change of the dimension of the gap G as PULLING FORCE OF THIRD EMBODIMENT using a solid curve with reference character C21 according to the third embodiment.

That is, this configuration makes difference between (1) A first value G2*a* of the gap dimension G at which the axial pulling force based on magnetic flux flowing through the second inner surfaces 1730 of the first and third core segments 17*a* and 17*c* has a first local peak (see FIG. 9)

(2) A second value G2*b* of the gap dimension G at which the axial pulling force based on magnetic flux flowing through the second inner surfaces 1730 of the second and fourth core segments 17*b* and 17*d* has a second local peak (see FIG. 9)

This configuration therefore enables complicated axial pulling-force characteristics depending on the gap dimension G, an example of which is illustrated in FIG. 9, to be obtained.

Additionally, the position of the edge 1770 of the first core segment 17*a* is substantially identical to the position of the edge 1770 of the third core segment 17*c* in the reciprocation direction of the movable core 18. This enables the radial pulling force generated by magnetic flux flowing through the second inner surface 1730 of the first core segment 17*a* to be substantially identical to the radial pulling force generated by magnetic flux flowing through the second inner surface 1730 of the third core segment 17*c*. Because the first and third core segments 17*a* and 17*c* are arranged to be symmetric with respect to the reciprocation direction, i.e. axial direction, of the movable core 18. This therefore enables the radial pulling force generated by magnetic flux flowing through the second inner surface 1730 of the first core segment 17*a* and the radial pulling force generated by magnetic flux flowing through the second inner surface 1730 of the third core segment 17*c* to cancel each other out.

Similarly, the position of the edge 1770 of the second core segment 17*b* is substantially identical to the position of the edge 1770 of the fourth core segment 17*d* in the reciprocation direction of the movable core 18. This enables the radial pulling force generated by magnetic flux flowing through the second inner surface 1730 of the second core segment 17*b* to be substantially identical to the radial pulling force generated by magnetic flux flowing through the second inner surface 1730 of the fourth core segment 17*d*. Because the second and fourth core segments 17*b* and 17*d* are arranged to be symmetric with respect to the reciprocation direction, i.e. axial direction, of the movable core 18. This therefore enables the radial pulling force generated by magnetic flux flowing through the second inner surface 1730 of the second core segment 17*b* and the radial pulling force generated by magnetic flux flowing through the second inner surface 1730 of the fourth core segment 17*d* to cancel each other out.

As described above, the electromagnetic relay 1B according to the third embodiment achieves, in addition to the first to third advantageous effects, an advantageous effect of easily obtaining complicated axial pulling-force characteristics depending on the gap dimension G.

Fourth Embodiment

The following describes the fourth embodiment of the present disclosure with reference to FIGS. 10 to 13.

The fourth embodiment differs from the first embodiment in the following points. So, the following mainly describes the different points, and omits or simplifies descriptions of like parts between the first and fourth embodiments, to which identical or like reference characters are assigned, thus eliminating redundant description.

Figure 10:
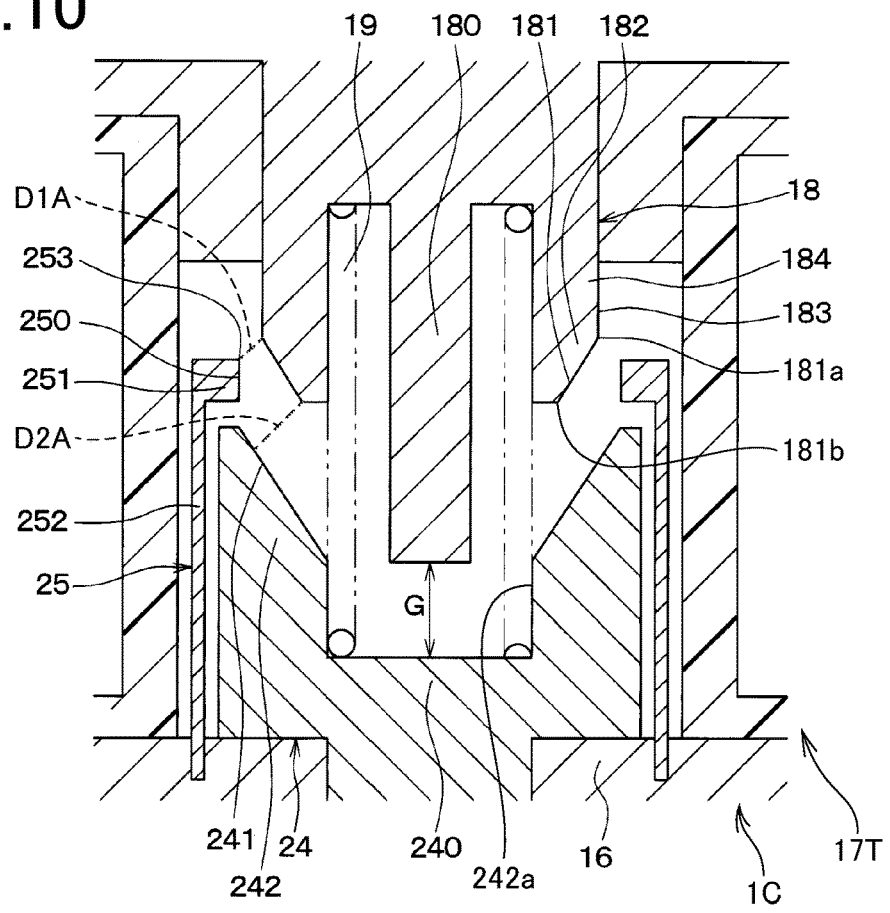
FIG. 10 is an enlarged axial cross sectional view schematically illustrating the principal components of an electromagnetic relay according to the fourth embodiment of the present disclosure.
Figure 11:
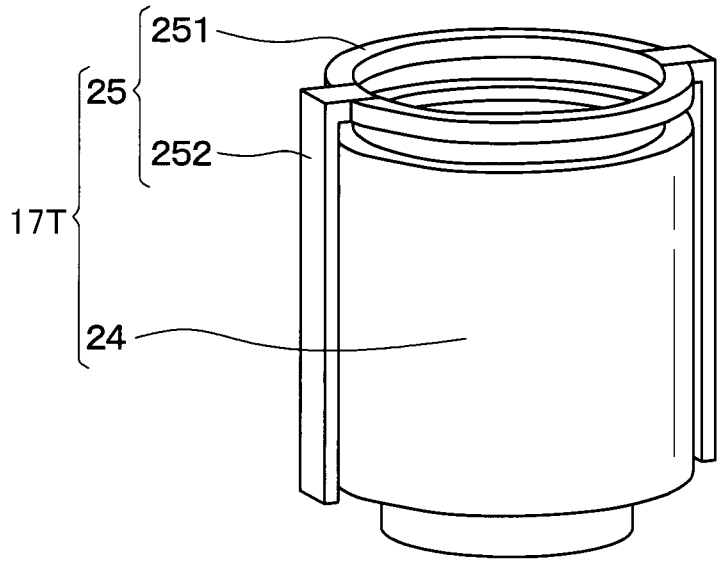
FIG. 11 is a perspective view schematically illustrating the principal components of the electromagnetic relay illustrated in FIG. 10

Referring to FIGS. 10 and 11, an electromagnetic relay 1C includes a stationary core 17T, and the stationary core 17T includes a main core member 24 and an auxiliary core member 25 configured to be separated from the main core member 24. The main core member 24 serves as a main magnetic circuit, and the auxiliary core member 25 serves as an auxiliary magnetic circuit.

The main core member 24 is made of, for example, a ferromagnetic metal material, and has a substantially cylindrical shape and a circular bottom 240 with a projection extending outwardly from the center of the bottom 170. The main core member 24 is coaxially installed in the bobbin 14*a* with an annular space between the outer circumferential surface of the main core member 24 and the inner circumferential surface of the bobbin 14*a*. The main core member 24 is mounted at its bottom 240 on the bottom 16*a* of the yoke 16 while the projection of the bottom is fitted in the through hole of the bottom 16*a* of the yoke 16.

The main core member 24 includes a taper portion 242.

The bottom 240 is the farthest member relative to the movable core 18, and the taper portion 242 coaxially extends from the bottom 240 toward the movable core 18. The taper portion 242 has an annular inner surface 242*a*, and an annular taper inner surface 241 coaxially continuing from the annular inner surface 242*a*. The annular inner surface 242*a* has a constant inner diameter, and the annular taper inner surface 241 has an inner diameter that becomes greater toward the movable core 18.

That is, the annular taper inner surface 241 is tapered toward the bottom 240 while the inner diameter of the annular taper inner surface 241 becomes narrower toward the bottom 240.

Referring to FIGS. 10 and 11, the auxiliary core member 25, which is made of, for example, a ferromagnetic metal material, includes a thin annular member 251. The thin annular member 251 has a thin thickness, and has an annular inner surface 250 with a constant inner diameter larger than the constant inner diameter of the annular inner surface 242*a*. The thin annular member 251 is located to be radially adjacent to the annular taper surface 181 of the movable core 18 when the gap dimension G has the maximum value. In other words, the thin annular member 251 is located such that the annular inner surface 250 faces the annular taper surface 181 of the movable core 18 when the gap dimension G has the maximum value.

The auxiliary core member 25 also includes a pair of first and second strip leg members 252. Each of the first and second strip leg members 252 has opposing first and second ends. The first strip leg member 252 is mounted at its first end to a first portion of the outer periphery of the thin annular member 251, and axially extends toward the yoke 16, so that the second end is mounted to the yoke 16. Similarly, the second strip leg member 252 is mounted at its first end to a second portion of the outer periphery of the thin annular member 251, and axially extends toward the yoke 16, so that the second end is mounted to the yoke 16. The second portion of the outer periphery of the thin annular member 251 are symmetric with respect to the axial direction of the thin annular member 251.

The annular inner surface 250 is located to be closer to the movable member 21 than the annular taper inner surface 241. Specifically, the annular inner surface 250 has an edge 253.

The edge 253 of the annular inner surface 250 is located to be substantially radially adjacent to the annular taper surface 181 of the movable core 18 when the gap dimension G has the maximum value.

When the gap dimension G has the maximum value, a first minimum distance D1A is shorter than a second minimum distance D2A. The first minimum distance D1A is defined as a minimum distance between the annular inner surface 250 and the annular taper surface 181, i.e. between the edge 253 of the annular inner surface 250 and the first edge 181*a* of the annular taper surface 181. The second minimum distance D2A is defined as a minimum distance between the annular taper inner surface 241 and the taper surface 181, i.e. between the annular taper inner surface 241 and the second edge 181*b*.

Each of the first and second strip leg members 252 serves as a part of the auxiliary magnetic circuit, and has a predetermined lateral cross section, i.e. a magnetic-path cross section. The magnetic-path cross section of each of the first and second strip leg members 252 has a predetermined area that causes magnetic saturation to occur when the gap dimension G is equal to or smaller than a predetermined dimension.

Next, how the electromagnetic relay 1C is operated.

FIG. 10 illustrates that the gap dimension G is maximized while the coil 14*b* is deenergized.

As described above, when the gap dimension G has the maximum value, the edge 253 of the annular inner surface 250 is located to be substantially radially adjacent to the annular taper surface 181 of the movable core 18. In addition, when the gap dimension G has the maximum value, the first minimum distance D1A between the annular inner surface 250 and the annular taper surface 181 is shorter than the second minimum distance D2A between the annular taper inner surface 241 and the taper surface 181.

When energization of the coil 14*b* is started, a first magnetic flux component induced in the movable core 18 by the coil 14*b* flows from the annular taper surface 181 to the annular taper surface 241 and a second magnetic flux component induced in the movable core 18 by the coil 14*b* flows from the annular taper surface 181 to the annular inner surface 250.

Because the first minimum distance D1A between the annular inner surface 250 and the annular taper surface 181 is shorter than the second minimum distance D2A between the annular taper inner surface 241 and the taper surface 181 when the gap dimension G has the maximum value, the second magnetic flux component flows from the annular taper surface 181 to the annular inner surface 250 easier than the first magnetic flux component flowing from the annular taper surface 181 to the annular taper inner surface 241. This causes the axial pulling force generated by the second magnetic flux component flowing through the auxiliary magnetic circuit, which is comprised of the thin annular member 251, the first and second strip leg members 252, and the yoke 16, to pull the movable core 18 toward the base 240 of the stationary core 17T.

Thereafter, as the movable core 18 moves to the stationary core 17, in other words, as the gap dimension G is reduced, the clearance between the annular taper surface 181 and the annular taper inner surface 241 becomes narrower. This causes the axial pulling force generated by the first magnetic flux component flowing through the main magnetic circuit, which is comprised of the taper portion 241, to increase in a substantially quadratic curve.

Accordingly, it is possible to obtain the axial pulling-force characteristics depending on the gap dimension G, which is identical to those illustrated in FIG. 4.

Each of the first and second strip leg members 252 has the predetermined lateral cross section, i.e. the magnetic-path cross section. The magnetic-path cross section of each of the first and second strip leg members 252 has the predetermined area that causes magnetic saturation to occur when the gap dimension G is equal to or smaller than the predetermined dimension.

That is, each of the first and second strip leg members 252 limits the amount of magnetic flux passing through the auxiliary magnetic circuit when the gap dimension G is equal to or smaller than the predetermined dimension. Limiting the magnetic flux flowing through the auxiliary magnetic circuit enables the amount of magnetic flux flowing through the main magnetic circuit to increase, thus increasing the axial pulling force generated by the magnetic flux flowing through the main magnetic circuit.

Accordingly, the electromagnetic relay 1C according to the fourth embodiment achieves the first to third advantageous effects, which is similar to the electromagnetic relay 1 according to the first embodiment.

Figure 12:
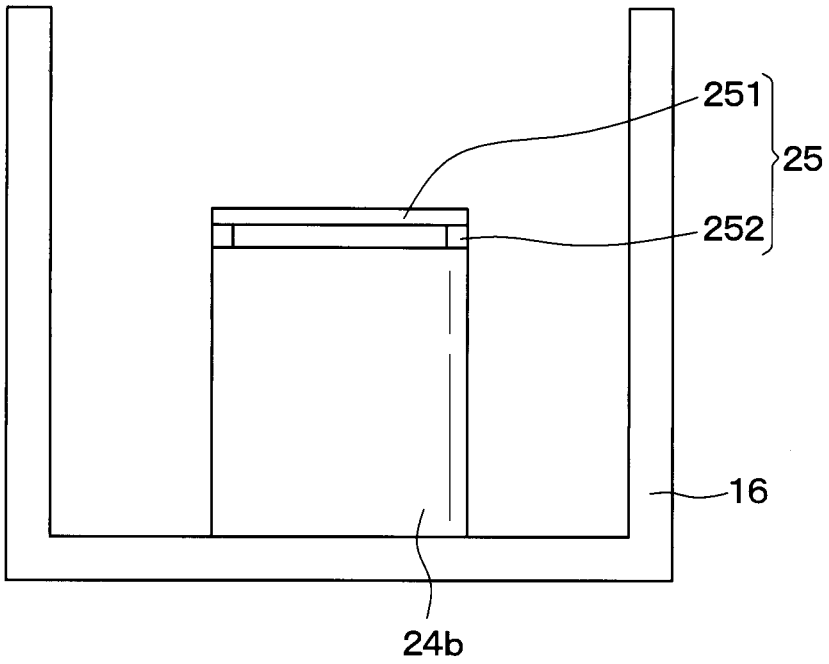
FIG. 12 is a schematic elevational view of the principle components of an electromagnetic relay according to a modification of the fourth embodiment.
Figure 13:
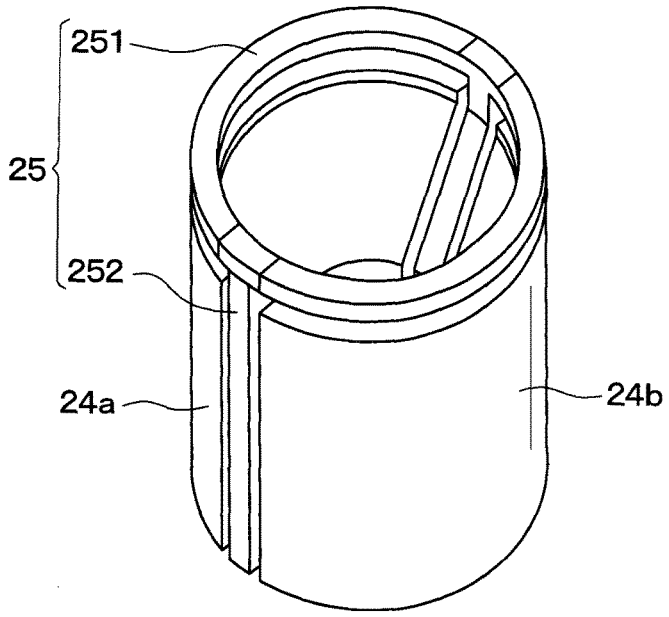
FIG. 13 is a perspective view schematically illustrating the principal components of the electromagnetic relay illustrated in FIG. 12

The main core member 24 is constructed by a single cylindrical member having the circular bottom 240, but the main core member 24 can be comprised of separated two members as illustrated in FIGS. 12 and 13.

Specifically, as illustrated in FIGS. 12 and 13, the main core member 24 is comprised of a first main core member 24*a* and a second main core member 24*b*. Each of the first and second core members 24*a* and 24*b* has a substantially half cylindrical shape, and the core assembly of the first and second core segments 24*a* and 24*b* constitutes a substantially cylindrical shape having the circular bottom 240.

That is, the first core segment 24*a* and the second core segment 24*b* are arranged to face each other in a radial direction of the movable core 18 with a pair of clearances therebetween. Each of the first and second strip leg members 252, whose first end is mounted to a corresponding one of the first and second portions of the thin annular member 251, is located in a corresponding one of the clearances.

For example, cutting a substantially cylindrical member having a bottom enables the assembly of the first core member 24*a*, the second core member 24*b*, and the auxiliary core member 25 to be easily constructed.

Fifth Embodiment

Figure 14:
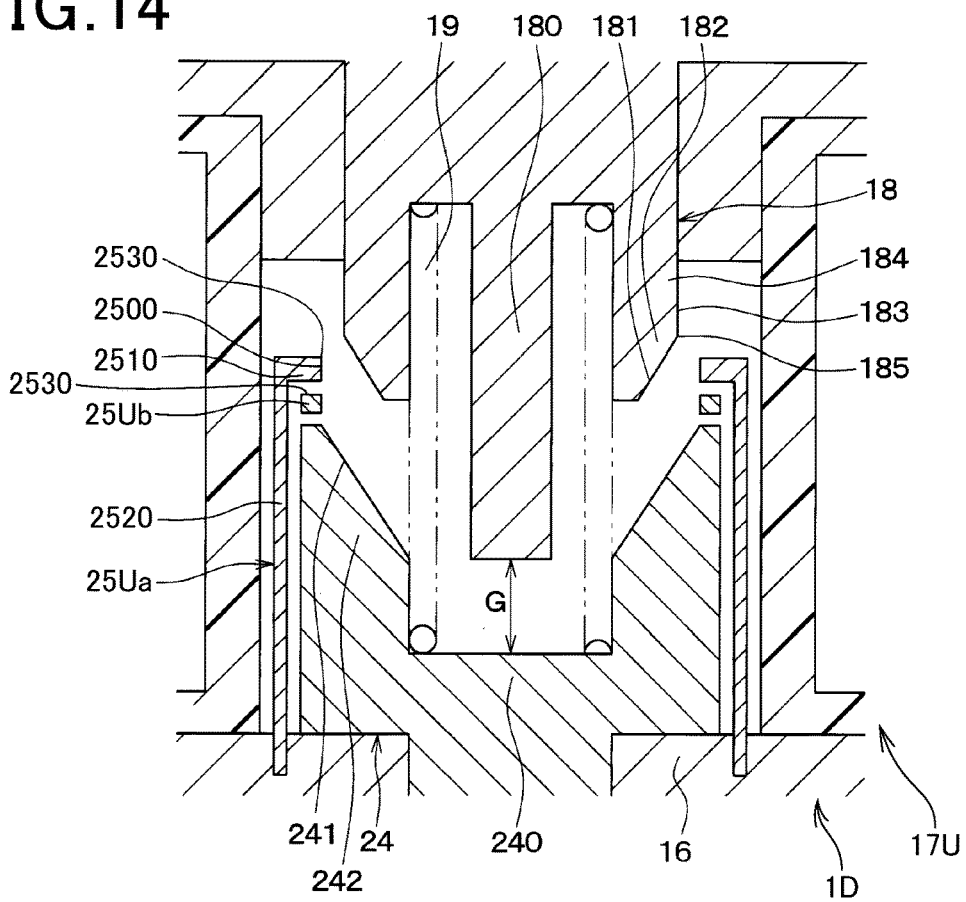
FIG. 14 is an enlarged axial cross sectional view schematically illustrating the principal components of an electromagnetic relay according to the fifth embodiment of the present disclosure.
Figure 15:
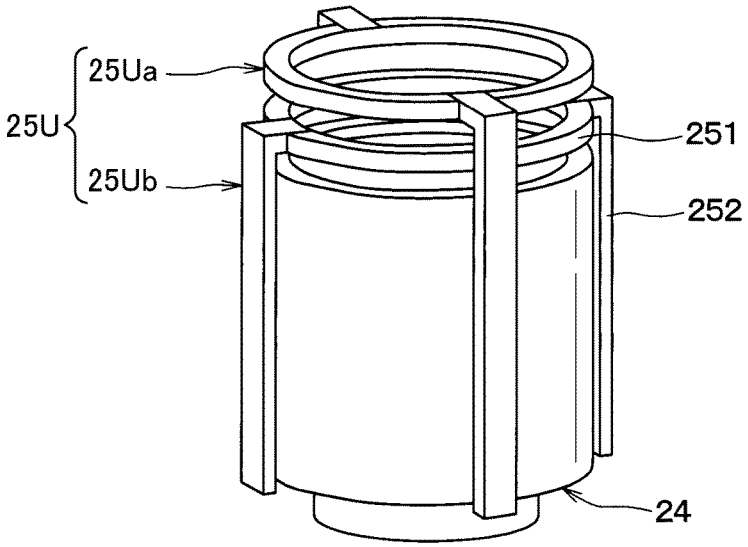
FIG. 15 is a perspective view schematically illustrating the principal components of the electromagnetic relay illustrated in FIG. 14.

The following describes the fifth embodiment of the present disclosure with reference to FIGS. 14 and 15.

The fifth embodiment differs from the first embodiment in the following points. So, the following mainly describes the different points, and omits or simplifies descriptions of like parts between the first and fifth embodiments, to which identical or like reference characters are assigned, thus eliminating redundant description.

Referring to FIGS. 14 and 15, an electromagnetic relay 1D includes a stationary core 17U, and the stationary core 17U includes the main core member 24 and an auxiliary core member 25U configured to be separated from the main core member 24. The main core member 24 serves as a main magnetic circuit, and the auxiliary core member 25U serves as an auxiliary magnetic circuit.

Referring to FIGS. 14 and 15, the auxiliary core member 25U, which is made of, for example, a ferromagnetic metal material, includes a first auxiliary core member 25Ua and a second auxiliary core member 25Ub.

Each of the first and second auxiliary core members 25Ua and 25Ub includes a thin annular member 2510 and a pair of first and second strip leg members 2520.

The following describes the structure of the first auxiliary core member 25Ua.

The thin annular member 2510 has a thin thickness, and has an annular inner surface 2500 with a constant inner diameter larger than the constant inner diameter of the annular inner surface 242*a*. The thin annular member 2510 is located to be radially adjacent to the annular taper surface 181 of the movable core 18 when the gap dimension G has the maximum value. In other words, the thin annular member 2510 is located such that the annular inner surface 2500 faces the annular taper surface 181 of the movable core 18 when the gap dimension G has the maximum value.

Each of the first and second strip leg members 2520 has opposing first and second ends. The first strip leg member 2520 is mounted at its first end to a first portion of the outer periphery of the thin annular member 2510, and axially extends toward the yoke 16, so that the second end is mounted to the yoke 16. Similarly, the second strip leg member 2520 is mounted at its first end to a second portion of the outer periphery of the thin annular member 2510, and axially extends toward the yoke 16, so that the second end is mounted to the yoke 16. The second portion of the outer periphery of the thin annular member 2510 are symmetric with respect to the axial direction of the thin annular member 2510.

The structure of the second auxiliary core member 25Ub is substantially identical to the structure of the first auxiliary core member 25Ua.

In particular, the first auxiliary core member 25Ua and the second auxiliary core member 25Ub are axially stacked over the main core member 24 with an axial clearance therebetween such that the first auxiliary core member 25Ua is located to be closer to the movable member 21 than the second auxiliary core member 25Ub to the movable member 21.

In addition, the first and second strip leg members 2520 of the first auxiliary core member 25Ua and the first and second strip leg members 2520 of the second auxiliary core member 25Ub are circumferentially arranged with regular intervals.

The annular inner surface 2500 of the second auxiliary core member 25Ub is located to be closer to the movable member 21 than the annular taper inner surface 241. The annular inner surface 2500 of the first auxiliary core member 25Ua is located to be closer to the movable member 21 than the annular inner surface 2500 of the second auxiliary core member 25Ub.

Specifically, the annular inner surface 2500 of each of the first and second auxiliary core members 25Ua and 25Ub has an edge 2530.

The edge 2530 of the annular inner surface 2500 of each of the first and second auxiliary core members 25Ua and 25Ub is located to be substantially radially adjacent to the annular taper surface 181 of the movable core 18 when the gap dimension G has the maximum value.

The first and second strip leg members 2520 of each of the first and second auxiliary core members 25Ua and 25Ub serve as a part of the auxiliary magnetic circuit.

Each of the first and second strip leg members 2520 of the first auxiliary core member 25Ua has a predetermined lateral cross section, i.e. a magnetic-path cross section. The magnetic-path cross section of each of the first and second strip leg members 2520 of the first auxiliary core member 25Ua has a predetermined area that causes magnetic saturation to occur when the gap dimension G is equal to or smaller than a predetermined dimension. Similarly, each of the first and second strip leg members 2520 of the second auxiliary core member 25Ub has a predetermined lateral cross section, i.e. a magnetic-path cross section. The magnetic-path cross section of each of the first and second strip leg members 2520 of the second auxiliary core member 25Ub has a predetermined area that causes magnetic saturation to occur when the gap dimension G is equal to or smaller than the predetermined dimension.

That is, the annular inner surface 2500 of the second auxiliary core member 25Ub is located to be closer to the movable member 21 than the annular taper inner surface 241. The annular inner surface 2500 of the first auxiliary core member 25Ua is located to be closer to the movable member 21 than the annular inner surface 2500 of the second auxiliary core member 25Ub.

This configuration makes difference between (1) A first value of the gap dimension G at which the axial pulling force based on magnetic flux flowing through the annular inner surface 2500 of the first auxiliary core member 25Ua has a first local peak (see FIG. 9)

(2) A second value of the gap dimension G at which the axial pulling force based on magnetic flux flowing through the annular inner surface 2500 of the second auxiliary core member 25Ub has a second local peak (see FIG. 9)

This configuration therefore enables complicated axial pulling-force characteristics depending on the gap dimension G, an example of which is illustrated in FIG. 9, to be obtained.

Each of the first and second strip leg members 2520 has the predetermined lateral cross section, i.e. the magnetic-path cross section. The magnetic-path cross section of each of the first and second strip leg members 2520 has the predetermined area that causes magnetic saturation to occur when the gap dimension G is equal to or smaller than the predetermined dimension.

That is, each of the first and second strip leg members 2520 limits the amount of magnetic flux passing through the auxiliary magnetic circuit when the gap dimension G is equal to or smaller than the predetermined dimension. Limiting the magnetic flux flowing through the auxiliary magnetic circuit enables the amount of magnetic flux flowing through the main magnetic circuit to increase, thus increasing the axial pulling force generated by the magnetic flux flowing through the main magnetic circuit.

Accordingly, the electromagnetic relay 1D according to the fifth embodiment achieves the first to third advantageous effects, which is similar to the electromagnetic relay 1 according to the first embodiment.

In addition, the electromagnetic relay 1D according to the fifth embodiment is configured such that the annular inner surface 2500 of the first auxiliary core member 25Ua is located to be different from the annular inner surface 2500 of the second auxiliary core member 25Ub in the reciprocation direction of the movable core 18.

This configuration achieves, in addition to the first to third advantageous effects, an advantageous effect of easily obtaining complicated axial pulling-force characteristics depending on the gap dimension G.

Sixth Embodiment

Figure 16:
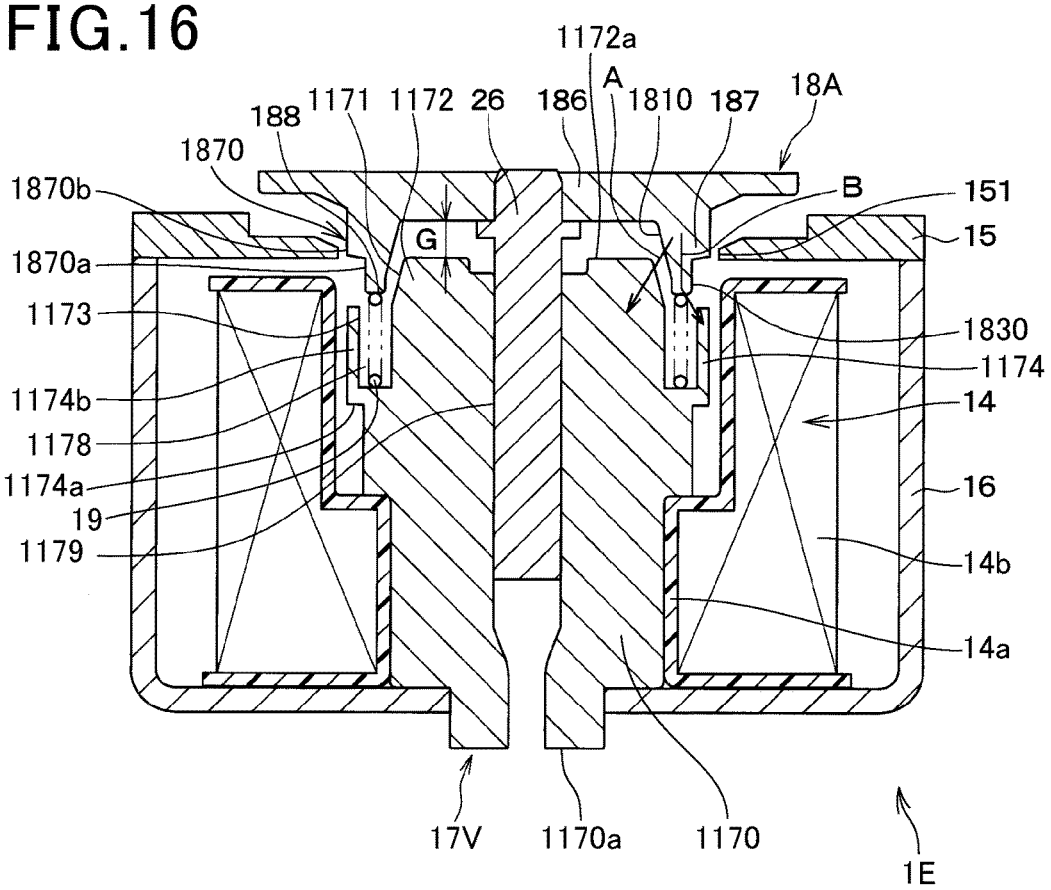
FIG. 16 is an enlarged axial cross sectional view schematically illustrating the principal components of an electromagnetic relay according to the sixth embodiment of the present disclosure while the gap is within a large range.
Figure 17:
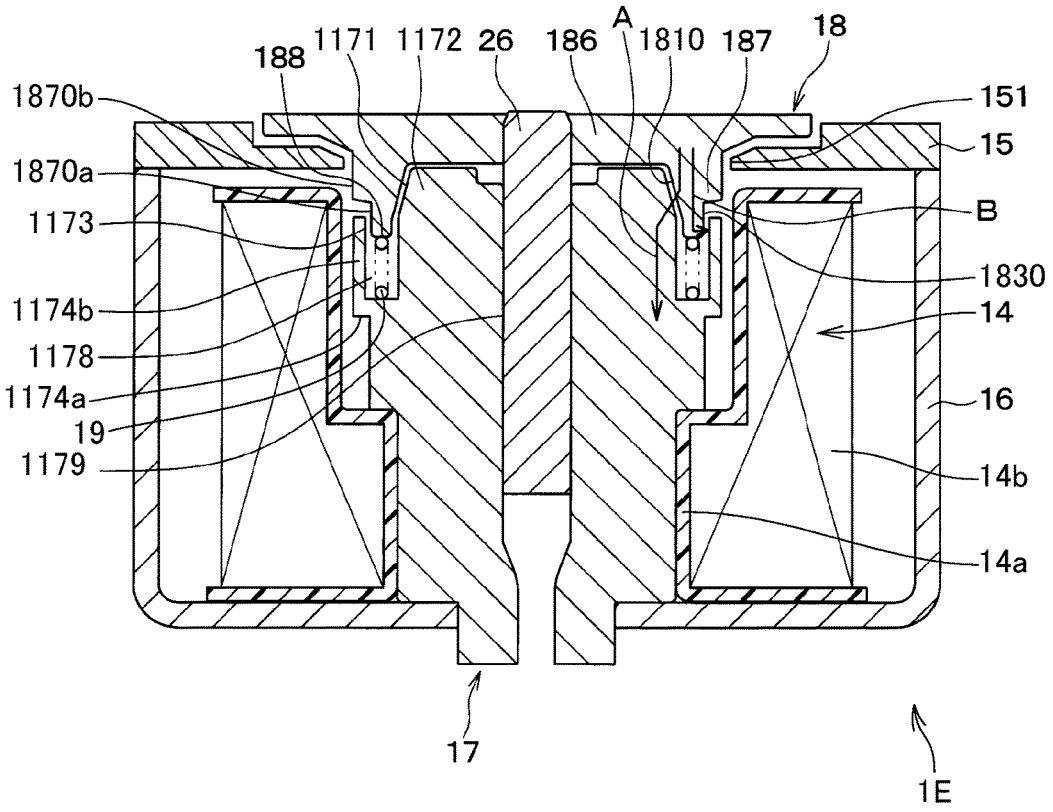
FIG. 17 is an enlarged axial cross sectional view schematically illustrating the principal components of the electromagnetic relay illustrated in FIG. 16 while the gap is within a small range.

The following describes the sixth embodiment of the present disclosure with reference to FIGS. 16 and 17.

The sixth embodiment differs from the first embodiment in the following points. So, the following mainly describes the different points, and omits or simplifies descriptions of like parts between the first and sixth embodiments, to which identical or like reference characters are assigned, thus eliminating redundant description.

Referring to FIGS. 16 and 17, an electromagnetic relay 1E includes a stationary core 17V.

The stationary core 17V includes a substantially cylindrical core body 1170 having a through hole, referred to as a guide hole, 1179 at its center axial portion. The core body 1170 includes, at its first axial end, an annular bottom 1170*a* with a projection extending outwardly from the annular bottom 1170*a*. The core body 1170 includes a taper portion 1172 at its second axial end opposite to the first axial end. The taper portion 1172 has an annular taper outer surface 1171. The annular taper outer surface 1171 has an outer diameter that becomes narrower toward the movable member 21.

The stationary core 17V also includes a projecting cylindrical portion 1174. The projecting cylindrical portion 174 is comprised of an annular bottom wall 1174*a* radially projecting from the outer circumferential surface of the core body 1170; the annular bottom wall 1174*a* is located to be closer to the bottom 1170*a* of the core body 1170 than the annular taper outer surface 1171 of the core body 1170 to the bottom 1170*a*. The projecting cylindrical portion 1174 includes an annular cylindrical wall 1174*b* projecting, from the outer edge of the annular bottom wall 1174*a*, toward the movable member 21 along the axial direction of the core body 1170 to provide an annular spring installation groove 1178. The electromagnetic relay 1E is configured such that the return spring 19 is installed in the spring installation groove 1178. The annular cylindrical wall 1174*b* has an annular inner surface 1173 has a constant inner diameter.

The annular cylindrical wall 1174*b* has a predetermined thickness serving as a magnetic path; the predetermined thickness enables magnetic saturation through the annular cylindrical wall 1174*b* to occur when the gap dimension G is equal to or smaller than the predetermined dimension. That is, the annular cylindrical wall 1174*b* serves as, for example, a magnetic flux limiter according to the sixth embodiment.

The movable core 18A includes a substantially annular plate 186 with a through hole and an annular cylindrical portion 187 with a shoulder 1870 projecting outwardly from its outer circumferential surface. The annular cylindrical portion 187 coaxially extends from the annular plate 186 toward the base 1170*a* of the stationary core 17V. The annular plate 15 has formed at its center potion a through hole 151 in which the shoulder 1870 of the annular cylindrical portion 187 of the movable core 18A is movably located while the annular plate 186 is located to be farther than the stationary core 17V than the plate 15 is.

The annular cylindrical portion 187 has an annular taper inner surface 1810 coaxially continuing from an inner surface of the annular plate 186. The annular taper inner surface 1810 has an inner diameter that becomes greater toward the base 1170*a* of the stationary core 1170. In other words, the inner diameter of the annular taper inner surface 1810 becomes narrower toward the annular plate 186.

The shoulder 1870 of the annular cylindrical portion 187 is comprised of a first annular portion 1870*a* and a second annular portion 1870*b*. The second annular portion 1870*b* axially extends from the inner surface of the annular plate 186 toward the bottom 1170*a* of the stationary core 17V, and the first annular portion 1870*a* axially extends from the extending end of the second annular potion 1870*b* toward the bottom 1170*a* of the stationary core 17V. The outer diameter of the first annular portion 1870*a* is shorter than the outer diameter of the second annular portion 1870*b*.

The first annular portion 1870*a* has an outer circumferential surface 1830 that has a constant outer diameter. The first annular portion 1870*a* can move into or move out of the annular spring installation groove 1178 based on axial movement of the movable core 18A.

The movable core 18A includes a metallic shaft 26 fixedly fitted in the through hole of the annular plate 186. The metallic shaft 26 is slidably fitted in the through hole 1179 of the core body 1170. The metallic shaft 26 has opposing first and second ends in its length direction. The first end of the metallic shaft 26 extends to be joined to the insulator 20 (see FIG. 1), and the second end of the metallic shaft 26 extends toward the base 1170*a* of the core body 1170.

The return spring 19 is installed in the annular spring installation groove 1178, and is sandwiched between an annular end surface 188 of the first annular portion 1870*a* and the bottom of the annular spring installation groove 1178.

When the movable core 18A is pulled to the stationary core 17V on energization of the coil 14*b*, the inner surface of the annular plate 186 located at the inner side of the annular cylindrical portion 187 is abutted onto an annular top surface 1172*a* of the taper portion 1172 of the core body 1170, which faces the inner surface of the annular plate 186 located at the inner side of the annular cylindrical portion 187. This enables movement of the movable core 18A to be restricted. That is, a gap dimension G according to the sixth embodiment is defined as a gap dimension between the inner surface of the annular plate 186 located at the inner side of the annular cylindrical portion 187 and the annular top surface 1172*a* of the taper portion 172 in the axial direction of the annular plate 186.

Next, the following describes how magnetic flux flows when the coil 14*b* is energized with reference to FIGS. 16 and 17.

Referring to FIG. 16, when energization of the coil 14*b* is started, a first magnetic flux component induced by the coil 14*b* flows from the annular taper surface 1810 to the annular taper outer surface 1171 while bypassing the annular wall 1174*b* as illustrated by arrow A, and a second magnetic flux component induced by the coil 14*b* flows from the annular end surface 188 to the annular wall 1174*b*.

The first magnetic flux component, which has flowed from the annular taper surface 1810 to the annular taper outer surface 1171 while has bypassed the annular cylindrical wall 1174*b*, flows through the taper portion 1172 and the core body 1170 to the yoke 16. The magnetic circuit including the annular cylindrical portion 187, the taper portion 1172, the core body 1160, and the yoke 16 through which the first magnetic flux component flows while bypassing the annular wall 1174*b* will be referred to as a main magnetic circuit according to the sixth embodiment.

On the other hand, the second magnetic flux component, which has flowed from the annular end surface 188 of the first annular portion 1870*a* to the annular wall 1174*b*, flows to the yoke 16 through the annular wall 1174*b*, the annular bottom wall 1174*a*, and the core body 1170. The magnetic circuit including the annular cylindrical portion 187, the annular wall 1174*b*, the annular bottom wall 1174*a*, and the yoke 16 through which the second magnetic flux component flows will be referred to as an auxiliary magnetic circuit according to the sixth embodiment.

When the gap dimension G has the maximum value, as illustrated by the arrow B, magnetic flux more easily flows through a first clearance between the annular end surface 188 of the first annular portion 1870*a* and the annular wall 1174*b* than magnetic flux flowing through a second clearance between the annular taper surface 1810 and the annular taper outer surface 1171.

This results in the axial pulling force generated by the second magnetic flux component flowing through the auxiliary magnetic circuit mainly pulling the movable core 18*a* to the bottom 1170*a* of the stationary core 17V.

Thereafter, as the movable core 18*a* moves to the stationary core 17V, the second clearance between the annular taper surface 1810 and the annular taper outer surface 1171 becomes narrower. This causes the axial pulling force generated by the first magnetic flux component flowing through the main magnetic circuit to increase in a substantially quadratic curve. The axial pulling force generated by the first magnetic flux component flowing through the main magnetic circuit according to the electromagnetic relay 1E however decreases as compared with the axial pulling force generated by the first magnetic flux component flowing through the main magnetic circuit according to the conventional electromagnetic relay. This is because the axial pulling force according to the electromagnetic relay 1E is smaller than the axial pulling force according to the conventional electromagnetic relay by the second magnetic flux component flowing through the auxiliary magnetic circuit.

When the gap dimension G is sufficiently wide, although the axial pulling force according to the electromagnetic relay 1E is smaller than the axial pulling force according to the conventional electromagnetic relay, it is possible to increase the total pulling force composed of the axial pulling force generated by the main magnetic circuit and the axial pulling force generated by the auxiliary magnetic circuit to be greater than the axial pulling force according to the conventional electromagnetic relay.

Referring to FIG. 17, when the gap dimension G is reduced as the movable core 18*a* is pulled to the stationary core 17V, the first annular portion 1870*a* starts to enter the annular spring installation groove 1178, so that the outer circumferential surface 1830 and the annular inner surface 1173 are radially overlapped with each other. Then, as illustrated by arrow B of FIG. 17, the vector of the second magnetic flux component flowing from the outer circumferential surface 1830 to the annular inner surface 1173 is directed in a radial direction of the stationary core 17V. This increases the radial pulling force. That is, the axial pulling force generated by the magnetic flux components flowing through the auxiliary magnetic circuit when the gap dimension G is within a small range is smaller than the axial pulling force generated by the magnetic flux components flowing through the auxiliary magnetic circuit when the gap dimension G is within a large range larger than the small range.

On the other hand, as the gap dimension G becomes smaller, the second clearance between the annular taper surface 1810 and the annular taper outer surface 1171 becomes narrower. This causes the axial pulling force generated by the first magnetic flux component flowing through the main magnetic circuit to the yoke 16 to increase.

While the gap dimension G is within the small range, the axial pulling force generated by the first magnetic flux component flowing through the main magnetic circuit becomes greater as the gap dimension G becomes smaller, but the axial pulling force generated by the second and third magnetic flux components flowing through the auxiliary magnetic circuit becomes smaller as the gap dimension G becomes smaller. This results in the total axial pulling force generated by the electromagnetic relay 1E being smaller than the total axial pulling force generated by the conventional electromagnetic relay.

The annular wall 1174*b* limits the amount of magnetic flux passing through the auxiliary magnetic circuit when the gap dimension G is equal to or smaller than the predetermined dimension. Limiting the magnetic flux flowing through the auxiliary magnetic circuit enables the amount of magnetic flux flowing through the main magnetic circuit to increase, thus increasing the axial pulling force generated by the magnetic flux flowing through the main magnetic circuit. This enables the axial pulling-force characteristics depending on the gap dimension G, an example of which is illustrated in FIG. 4, to be obtained.

Accordingly, the electromagnetic relay 1E according to the sixth embodiment achieves the first to third advantageous effects, which is similar to the electromagnetic relay 1 according to the first embodiment.

Each of the electromagnetic relays 1 to 1E can be configured such that magnetic flux flows from the stationary core to the movable core.

Modifications

The present disclosure is not limited to the above described embodiments, and can be variably modified within the scope of the present disclosure.

In each of the first to sixth embodiments, an electromagnetic driver is applied to a corresponding one of the electromagnetic relays 1 to 1E, but can be applied to an electromagnetic valve or solenoid for opening or closing a fluid passage.

Even if the number of elements, the values of elements, the amounts of elements, and the ranges of elements are disclosed in the specification, the present disclosure is not limited thereto except where they are clearly described as essential or they are principally estimated to be essential. Even if the shapes, locations, and positional relationships of elements are disclosed in the specification, the present disclosure is not limited thereto except if they are clearly described as essential or they are principally estimated to be essential.

While the illustrative embodiments of the present disclosure have been described herein, the present disclosure is not limited to the embodiment described herein, but includes any and all embodiments having modifications, omissions, combinations (e.g., of aspects across various embodiments), adaptations and/or alternations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. An electromagnetic driver comprising:

a stationary core;

a movable core located to face the stationary core with a variable gap relative to the stationary core, the movable core being configured to be reciprocable relative to the stationary core;

a spring configured to urge the movable core to be away from the stationary core; and a coil configured to generate magnetic flux when energized, wherein the stationary core comprises:

a main magnetic circuit through which a first component of the magnetic flux flows, the main magnetic circuit being configured such that:

first pulling force generated based on the first component of the magnetic flux flowing through the main magnetic path pulls the movable core in a reciprocation direction of the movable core; and the first pulling force increases with a reduction of a dimension of the gap; and an auxiliary magnetic circuit through which a second component of the magnetic flux flows, the auxiliary magnetic circuit being configured such that:

second pulling force generated based on the second component of the magnetic flux flowing through the auxiliary magnetic path pulls the movable core in the reciprocation direction of the movable core; and the second pulling force with the dimension of the gap being within a first range is changed to be higher than the second pulling force with the dimension of the gap being within a second range, the second range being smaller than the first range.

2. The electromagnetic driver according to claim 1, wherein:

the stationary core comprises a magnetic flux limiter included in the auxiliary circuit, the magnetic flux limiter being configured to limit the second component of the magnetic flux flowing therethrough when the dimension of the gap is equal to or smaller than a predetermined dimension.

3. The electromagnetic driver according to claim 1, wherein:

the stationary core comprises:

a main core member constituting the main magnetic circuit; and an auxiliary core member configured to be separated from the main core member, the auxiliary core member constituting the auxiliary magnetic circuit.

4. The electromagnetic driver according to claim 1, wherein:

the stationary core has opposing first and second ends in the reciprocation direction of the movable core, the first end being closer to the movable core than the second end is; and the first end of the stationary core comprises a plurality of portions respectively having different positions in the reciprocation direction of the movable core.

5. The electromagnetic driver according to claim 1, wherein:

the movable core comprises:

an outer circumferential surface having a constant outer diameter; and an outer circumferential taper surface having an outer diameter that is tapered toward the stationary core;

the stationary core comprises:

an annular inner surface having a constant inner diameter; and an annular taper inner surface c having an inner diameter that is tapered toward a direction opposite to the movable core, the annular taper inner surface being located to face the annular taper outer surface;

the main magnetic circuit comprises a first magnetic path including the circumferential taper outer surface and the annular taper inner surface, the first component of the magnetic flux flowing through the first magnetic path; and the auxiliary magnetic circuit comprises at least one of a second magnetic path including the circumferential taper outer surface and the annular taper inner surface, and a third magnetic path including the outer circumferential surface and the annular inner surface, the second component of the magnetic flux flowing through the at least one of the second magnetic path and the third magnetic path.

6. The electromagnetic driver according to claim 1, wherein:

the movable core comprises a first annular cylindrical portion that has:

an annular inner surface having a constant inner diameter;

an annular taper inner surface having an inner diameter that is tapered toward a direction opposite to the stationary core; and an end surface facing the stationary core;

the stationary core comprises:

a second annular cylindrical portion having an annular outer surface that has a constant outer diameter; and an annular taper portion having an annular taper outer surface that has an outer diameter that is tapered toward the movable core, the annular taper outer surface being located to face the annular taper inner surface;

the main magnetic circuit comprises a first magnetic path including the annular taper inner surface of the first annular cylindrical portion and the annular taper outer surface of the second annular cylindrical portion, the first component of the magnetic flux flowing through the first magnetic path; and the auxiliary magnetic circuit comprises at least one of a second magnetic path including the annular inner surface of the first annular cylindrical portion and the annular outer surface of the second annular cylindrical portion, and a third magnetic path including the end surface of the first annular cylindrical portion and the annular outer surface of the second annular cylindrical portion, the second component of the magnetic flux flowing through the at least one of the second magnetic path and the third magnetic path.

7. The electromagnetic driver according to claim 1, wherein:

the auxiliary magnetic circuit is configured such that:

the second pulling force decreases and third pulling force in a direction perpendicular to the reciprocation direction of the movable core increases with a reduction of the dimension of the gap.

* * * * *